US008383311B2

(12) United States Patent
Cheng et al.

(10) Patent No.: US 8,383,311 B2
(45) Date of Patent: Feb. 26, 2013

(54) EMULSION AGGREGATION TONER COMPOSITION

(75) Inventors: Chieh-Min Cheng, Rochester, NY (US); Zhen Lai, Webster, NY (US); Zhaoyang Ou, Webster, NY (US); Dennis A. Mattison, Jr., Marion, NY (US); Phil Dale, Hamlin, NY (US); Christopher D. Blair, Webster, NY (US); Steven M. Malachowski, East Rochester, NY (US); Ryan Accetta, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 680 days.

(21) Appl. No.: 12/575,972

(22) Filed: Oct. 8, 2009

(65) Prior Publication Data

US 2011/0086301 A1 Apr. 14, 2011

(51) Int. Cl.
*G03G 9/08* (2006.01)

(52) U.S. Cl. ..... 430/109.4; 430/108.1; 430/108.4; 430/108.6

(58) Field of Classification Search ..... 430/109.4, 430/108.1, 108.3, 108.4, 108.7
See application file for complete search history.

(56) References Cited

U.S. PATENT DOCUMENTS

| | | | |
|---|---|---|---|
| 3,681,106 | A | 8/1972 | Burns et al. |
| 3,847,604 | A | 11/1974 | Hagenbach et al. |
| 4,533,614 | A | 8/1985 | Fukumoto et al. |
| 4,845,006 | A | 7/1989 | Matsubara et al. |
| 4,863,824 | A | 9/1989 | Uchida et al. |
| 4,863,825 | A | 9/1989 | Yoshimoto et al. |
| 4,917,983 | A | 4/1990 | Uchida et al. |
| 4,931,370 | A | 6/1990 | Amaya et al. |
| 4,933,252 | A | 6/1990 | Nishikawa et al. |
| 4,935,326 | A | 6/1990 | Creatura et al. |
| 4,937,166 | A | 6/1990 | Creatura et al. |
| 4,957,774 | A | 9/1990 | Doi et al. |
| 4,973,539 | A | 11/1990 | Sacripante et al. |
| 4,980,448 | A | 12/1990 | Tajiri et al. |
| 4,981,939 | A | 1/1991 | Matsumura et al. |
| 4,988,794 | A | 1/1991 | Kubo et al. |
| 5,057,392 | A | 10/1991 | McCabe et al. |
| 5,057,596 | A | 10/1991 | Kubo et al. |
| 5,143,809 | A | 9/1992 | Kaneko et al. |
| 5,147,747 | A | 9/1992 | Wilson et al. |
| 5,227,460 | A | 7/1993 | Mahabadi et al. |
| 5,231,135 | A | 7/1993 | Machell et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,376,494 | A | 12/1994 | Mahabadi et al. |
| 5,403,693 | A | 4/1995 | Patel et al. |
| 5,405,728 | A | 4/1995 | Hopper et al. |
| 5,409,557 | A | 4/1995 | Mammino et al. |
| 5,418,108 | A | 5/1995 | Kmiecik-Lawrynowicz et al. |
| 5,480,756 | A | 1/1996 | Mahabadi et al. |
| 5,487,707 | A | 1/1996 | Sharf et al. |
| 5,496,676 | A | 3/1996 | Croucher et al. |
| 5,500,324 | A | 3/1996 | Mahabadi et al. |
| 5,501,935 | A | 3/1996 | Patel et al. |
| 5,514,436 | A | 5/1996 | Schlueter, Jr. et al. |
| 5,527,658 | A | 6/1996 | Hopper et al. |
| 5,560,484 | A | 10/1996 | Tomisawa et al. |
| 5,578,407 | A * | 11/1996 | Kasuya et al. ..... 430/45.55 |
| 5,585,215 | A | 12/1996 | Ong et al. |
| 5,593,807 | A | 1/1997 | Sacripante et al. |
| 5,601,960 | A | 2/1997 | Mahabadi et al. |
| 5,621,022 | A | 4/1997 | Jaeger et al. |
| 5,629,121 | A | 5/1997 | Nakayama |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,750,909 | A | 5/1998 | Hawkins et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,944 | A | 12/1998 | Foucher et al. |
| 5,869,215 | A | 2/1999 | Ong et al. |
| 5,916,725 | A | 6/1999 | Patel et al. |
| 6,099,673 | A | 8/2000 | Van Bennekom |
| 6,120,967 | A | 9/2000 | Hopper et al. |
| 6,221,137 | B1 | 4/2001 | King et al. |
| 6,326,119 | B1 | 12/2001 | Hollenbaugh, Jr. et al. |
| 6,358,657 | B1 | 3/2002 | Silence et al. |
| 6,359,105 | B1 | 3/2002 | Ianni et al. |
| 6,383,705 | B2 | 5/2002 | Aoki et al. |
| 6,408,753 | B1 | 6/2002 | Finn et al. |
| 6,472,523 | B1 | 10/2002 | Banning et al. |
| 6,476,219 | B1 | 11/2002 | Duff et al. |
| 6,576,747 | B1 | 6/2003 | Carlini et al. |
| 6,576,748 | B1 | 6/2003 | Carlini et al. |
| 6,590,082 | B1 | 7/2003 | Banning et al. |
| 6,592,913 | B2 | 7/2003 | Cook et al. |
| 6,593,053 | B1 | 7/2003 | Chang et al. |
| 6,646,111 | B1 | 11/2003 | Carlini et al. |

(Continued)

FOREIGN PATENT DOCUMENTS

| | | | |
|---|---|---|---|
| JP | 08314179 | A * | 11/1996 |
| WO | WO2005015319 | A * | 2/2005 |

OTHER PUBLICATIONS

English language machine translation of JP 08-314179 (Nov. 1996).*

*Primary Examiner* — Christopher Rodee
(74) *Attorney, Agent, or Firm* — Oliff & Berridge, PLC

(57) ABSTRACT

A toner composition that includes at least one low molecular weight amorphous polyester resin, at least one high molecular weight amorphous polyester resin, at least one crystalline polyester resin, at least one wax, at least one biocide and at least one colorant, and wherein the toner composition has a minimum fusing temperature of from about 100° C. to about 125° C.

24 Claims, No Drawings

U.S. PATENT DOCUMENTS

| | | | | |
|---|---|---|---|---|
| 6,663,703 | B1 | 12/2003 | Wu et al. | |
| 6,673,139 | B1 | 1/2004 | Wu et al. | |
| 6,696,552 | B2 | 2/2004 | Mayo et al. | |
| 6,713,614 | B2 | 3/2004 | Carlini et al. | |
| 6,726,755 | B2 | 4/2004 | Titterington et al. | |
| 6,755,902 | B2 | 6/2004 | Banning et al. | |
| 6,780,557 | B2 | 8/2004 | Kawaji et al. | |
| 6,821,327 | B2 | 11/2004 | Jaeger et al. | |
| 6,942,951 | B2 | 9/2005 | Daimon et al. | |
| 6,958,406 | B2 | 10/2005 | Banning et al. | |
| 7,029,817 | B2 | 4/2006 | Robinson et al. | |
| 7,053,227 | B2 | 5/2006 | Jaeger et al. | |
| 7,056,635 | B2 | 6/2006 | Tanaka et al. | |
| 7,329,476 | B2 | 2/2008 | Sacripante et al. | |
| 7,381,831 | B1 | 6/2008 | Banning et al. | |
| 7,427,323 | B1 | 9/2008 | Birau et al. | |
| 7,648,812 | B2 * | 1/2010 | Umehara | 430/108.21 |
| 2006/0216626 | A1 | 9/2006 | Sacripante et al. | |
| 2006/0223934 | A1 | 10/2006 | Chen et al. | |
| 2006/0292477 | A1 * | 12/2006 | Daimon et al. | 430/109.4 |
| 2007/0141498 | A1 * | 6/2007 | Umehara | 430/108.21 |
| 2008/0107990 | A1 | 5/2008 | Field et al. | |
| 2008/0131802 | A1 * | 6/2008 | Mizutani et al. | 430/109.4 |
| 2008/0166648 | A1 * | 7/2008 | Veregin et al. | 430/108.6 |
| 2008/0236446 | A1 | 10/2008 | Zhou et al. | |
| 2009/0047593 | A1 | 2/2009 | Vanbesien et al. | |
| 2009/0123863 | A1 * | 5/2009 | Ashizawa et al. | 430/109.4 |
| 2010/0173239 | A1 * | 7/2010 | Iftime et al. | 430/107.1 |

* cited by examiner

EMULSION AGGREGATION TONER COMPOSITION

BACKGROUND

This present disclosure relates to toners and developers containing the toners for use in forming and developing images, and in particular to toners formed using emulsion aggregation. The disclosure also relates to processes for producing and using such toners and developers.

Emulsion aggregation (EA) toners are used in forming print and/or xerographic images. Emulsion aggregation techniques typically involve the formation of an emulsion latex of the resin particles, which particles have a small size of from, for example, about 5 to about 500 nanometers in diameter, by heating the resin, optionally with solvent if needed, in water, or by making a latex in water using an emulsion polymerization. A colorant dispersion, for example of a pigment dispersed in water, optionally also with additional resin, is separately formed. The colorant dispersion is added to the emulsion latex mixture, and an aggregating agent or complexing agent is then added and/or aggregation otherwise initiated to form aggregated toner particles. The aggregated toner particles are heated to enable coalescence/fusing, thereby achieving aggregated, fused toner particles, United States patents describing emulsion aggregation toners include, for example, U.S. Pat. Nos. 5,370,963, 5,418,108, 5,290,654, 5,278,020, 5,308,734, 5,344,738, 5,403,693, 5,364,729, 5,346,797, 5,348,832, 5,405,728, 5,366,841, 5,496,676, 5,527,658, 5,585,215, 5,650,255, 5,650,256, 5,501,935, 5,723,253, 5,744,520, 5,763,133, 5,766,818, 5,747,215, 5,827,633, 5,853,944, 5,804,349, 5,840,462, and 5,869,215, each of which are incorporated by reference herein in their entirety.

Two main types of emulsion aggregation toners are known. First is an emulsion aggregation process that forms acrylate based, for example, styrene acrylate, toner particles. See, for example, U.S. Pat. No. 6,120,967, the entire disclosure of which is incorporated herein by reference, as one example of such a process. Second is an emulsion aggregation (EA) process that forms polyester, for example, sodio sulfonated polyester, toner particles. See, for example, U.S. Pat. No. 5,916,725, the entire disclosure of which is incorporated herein by reference, as one example of such a process. Alternatively, toner particles can be formed via an EA process that uses preformed polyester latex emulsions made using solvent flash or phase inversion emulsification (PIE) such as those toner methods described in U.S. Patent Application Publication No. 2008/0236446, the entire disclosure of which is incorporated herein by reference. Additionally, so-called ultra low melt polyester toners can be obtained by incorporation of a suitable crystalline polyester. Examples of EA ultra low melt (ULM) polyester toners, include those described in U.S. Pat. Nos. 5,057,392, 5,147,747, 6,383,705, 6,780,557, 6,942,951, 7,056,635 and U.S. Patent Application Pub. No. 2008/0236446, the disclosures of which are incorporated by reference in their entirety.

Emulsion aggregation polyester-based toners have begun to replace styrene-acrylate toners due to the lower achievable minimum fixing temperatures (MFT), wide fusing latitude, good release, high gloss, high blocking temperature, robust particles and suitable triboelectric properties of polyester-based toners. More particularly, lower MFT toners provide the opportunity for higher print productivity and/or reduced fusing temperatures, and therefore lower printer power consumption. However, not all lower MFT toners are suitable to be used in all printing platforms.

SUMMARY

What is still desired is an improved emulsion aggregation toner composition that overcomes or alleviates the above-described and other problems experienced in the art. Such a toner composition would be suitable for high speed printing that can provide excellent release and hot offset characteristics, minimum fixing temperature, and suitable small toner particle size characteristics.

The above and other issues are addressed by the present application, wherein in embodiments, described herein is a toner composition comprising at least one low molecular weight amorphous polyester resin, at least one high molecular weight amorphous polyester resin, at least one crystalline polyester resin, at least one wax, at least one biocide, and at least one colorant, wherein the at least one low molecular weight amorphous polyester resin is present in the toner composition in an amount of about 25 to about 50 weight percent, the at least one high molecular weight amorphous polyester resin is present in the toner composition in an amount of about 25 to about 50 weight percent, the at least one crystalline polyester resin is present in the toner composition in an amount of 1 to about 15 weight percent, the at least one wax is present in the toner composition in an amount of 1 to about 15 weight percent, the at least one biocide is present in the toner composition in a concentration of 950 ppm to about 1000 ppm, and the at least one colorant is present in the toner composition in an amount of 1 to about 15 weight percent, and wherein the toner composition has a minimum fusing temperature of from about 100° C. to about 125° C.

In embodiments, described is a toner composition comprising at least one low molecular weight amorphous polyester resin, at least one high molecular weight amorphous polyester resin, at least one crystalline polyester resin, at least one wax and at least one colorant, wherein the at least one low molecular weight amorphous polyester resin is present in the toner composition in an amount of about 25 to about 50 weight percent, the at least one high molecular weight amorphous polyester resin is present in the toner composition in an amount of about 25 to about 50 weight percent, the at least one crystalline polyester resin is present in the toner composition in an amount of 1 to about 15 weight percent, the at least one wax is present in the toner composition in an amount of 1 to about 15 weight percent, the at least one biocide is present in the toner composition in a concentration of 950 ppm to about 1000 ppm, and the at least one colorant is present in the toner composition in an amount of 1 to about 15 weight percent, wherein the toner composition has a minimum fusing temperature of from about 100° C. to about 125° C., and wherein the toner composition has a hot offset temperature of from about 215° C. to about 250° C.

In further embodiments, described is an image fainting device, comprising a development system including a toner composition, and a fuser member, wherein the toner composition is comprised of at least one low molecular weight amorphous polyester resin, at least one high molecular weight amorphous polyester resin, at least one crystalline polyester resin, at least one wax and at least one colorant, wherein the at least one low molecular weight amorphous polyester resin is present in the toner composition in an amount of about 25 to about 50 weight percent, the at least one high molecular weight amorphous polyester resin is present in the toner composition in an amount of about 25 to about 50 weight percent, the at least one crystalline polyester resin is present in the toner composition in an amount of 1 to about 15 weight percent, the at least one wax is present in the toner composition in an amount of 1 to about 15 weight percent, the at least one biocide is present in the toner composition in a concentration of 950 ppm to about 1000 ppm, and the at least one colorant is present in the toner composition in an amount of 1 to about 15 weight percent, and wherein the toner composition has a minimum fusing temperature of from about 100° C. to about 125° C., and wherein the fuser member comprises a substrate and an outer layer comprising a fluoropolymer.

EMBODIMENTS

Described herein is a toner composition that includes at least one low molecular weight amorphous polyester resin, at least one high molecular weight amorphous polyester resin, at least one biocide, at least one crystalline polyester resin, at least one wax and at least one colorant. The at least one low molecular weight amorphous polyester resin may be present in the toner composition in an amount of about 25 to about 50 weight percent. The at least one high molecular weight amorphous polyester resin may be present in the toner composition in an amount of about 25 to about 50 weight percent. The at least one crystalline polyester resin may be present in the toner composition in an amount of 1 to about 15 weight percent. The at least one wax may be present in the toner composition in an amount of 1 to about 15 weight percent. The at least one colorant may be present in the toner composition in an amount of 1 to about 15 weight percent.

Low Molecular Amorphous Polyester Resin

The toner composition includes at least one low molecular weight linear amorphous polyester resin. The low molecular weight amorphous polyester resins, which are available from a number of sources, can possess various melting points of, for example, from about 30° C. to about 120° C., such as from about 75° C. to about 115° C., from about 100° C. to about 110° C., and from about 104° C. to about 110° C. As used herein, the low molecular weight amorphous polyester resin has, for example, a number average molecular weight ($M_n$), as measured by gel permeation chromatography (GPC) of, for example, from about 1,000 to about 10,000, such as from about 2,000 to about 8,000, from about 3,000 to about 8,000, and from about 4,000 to about 6,000. The weight average molecular weight ($M_w$) of the resin is 50,000 or less, for example, from about 2,000 to about 50,000, from about 3,000 to about 40,000, from about 10,000 to about 30,000 and from about 18,000 to about 21,000, as determined by GPC using polystyrene standards. The molecular weight distribution ($M_w/M_n$) of the crystalline resin is, for example, from about 2 to about 6, and more specifically, from about 2 to about 4. The low molecular weight amorphous polyester resins may have an acid value of about 8 to about 20 mg KOH/g, from about 8 to about 16 mg KOH/g and from about 9 to about 14 mg KOH/g.

Examples of the linear amorphous polyester resins include poly(propoxylated bisphenol A co-fumarate), poly(ethoxylated bisphenol A co-fumarate), poly(butyloxylated bisphenol A co-fumarate), poly(co-propoxylated bisphenol A co-ethoxylated bisphenol A co-fumarate), poly(1,2-propylene fumarate), poly(propoxylated bisphenol A co-maleate), poly(ethoxylated bisphenol A co-maleate), poly(butyloxylated bisphenol A co-maleate), poly(co-propoxylated bisphenol A co-ethoxylated bisphenol A co-maleate), poly(1,2-propylene maleate), poly(propoxylated bisphenol A co-itaconate), poly(ethoxylated bisphenol A co-itaconate), poly(butyloxylated bisphenol A co-itaconate), poly(co-propoxylated bisphenol A co-ethoxylated bisphenol A co-itaconate), poly(1,2-propylene itaconate), and combinations thereof.

In embodiments, a suitable linear amorphous polyester resin may be a poly(propoxylated bisphenol A co-fumarate) resin having the following formula (II):

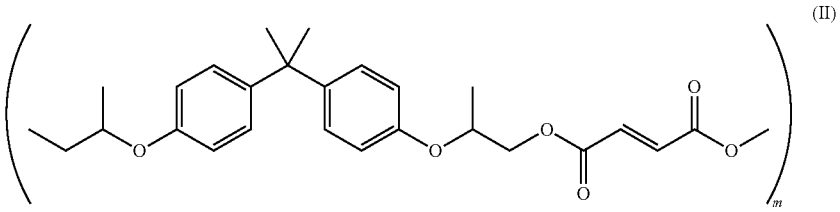

(II)

wherein m may be from about 5 to about 1000.

An example of a linear propoxylated bisphenol A fumarate resin which may be utilized as a latex resin is available under the trade name SPARII™ from Resana S/A Industrias Quimicas, Sao Paulo Brazil. Other suitable linear resins include those disclosed in U.S. Pat. Nos. 4,533,614, 4,957,774 and 4,533,614, which can be linear polyester resins including terephthalic acid, dodecylsuccinic acid, trimellitic acid, fumaric acid and alkyloxylated bisphenol A, such as, for example, bisphenol-A ethylenoxide adducts and bisphenol-A propylenoxide adducts. Other propoxylated bisphenol A terephthalate resins that may be utilized and are commercially available include GTU-FC115, commercially available from Kao Corporation, Japan, and the like.

In embodiments, the low molecular weight amorphous polyester resin may be a saturated or unsaturated amorphous polyester resin. Illustrative examples of saturated and unsaturated amorphous polyester resins selected for the process and particles of the present disclosure include any of the various amorphous polyesters, such as polyethylene-terephthalate, polypropylene-terephthalate, polybutylene-terephthalate, polypentylene-terephthalate, polyhexylene-terephthalate, polyheptadene-terephthalate, polyoctalene-terephthalate, polyethylene-isophthalate, polypropylene-isophthalate, polybutylene-isophthalate, polypentylene-isophthalate, polyhexalene-isophthalate, polyheptadene-isophthalate, polyoctalene-isophthalate, polyethylene-sebaeate, polypropylene sebacate, polybutylene-sebacate, polyethylene-adipate, polypropylene-adipate, polybutylene-adipate, polypentylene-adipate, polyhexylene-adipate, polyheptadene-adipate, polyoctalene-adipate, polyethylene-glutarate, polypropylene-glutarate, polybutylene-glutarate, polypentylene-glutarate, polyhexylene-glutarate, polyheptadene-glutarate, polyoctalene-glutarate polyethylene-pimelate, polypropylene-pimelate, polybutylene-pimelate, polypentylene-pimelate, polyhexalene-pimelate, polyheptadene-pimelate, poly(ethoxylated bisphenol A-fumarate), poly(ethoxylated bisphenol A-succinate), poly(ethoxylated bisphenol A-adipate), poly(ethoxylated bisphenol A-glutarate), poly(ethoxylated bisphenol A-terephthalate), poly (ethoxylated bisphenol A-isophthalate), poly(ethoxylated bisphenol A-dodecenylsuccinate), poly(propoxylated bisphenol A-fumarate), poly(propoxylated bisphenol A-succinate), poly(propoxylated bisphenol A-adipate), poly(propoxylated bisphenol A-glutarate), poly(propoxylated bisphenol A-terephthalate), poly(propoxylated bisphenol A-isophthalate), poly(propoxylated bisphenol A-dodecenylsuccinate), SPAR (Dixie Chemicals), BECKOSOL (Reichhold Inc), ARAKOTE (Ciba-Geigy Corporation), HETRON (Ashland Chemical), PARAPLEX (Rohm & Haas), POLYLITE (Reichhold Inc), PLASTHALL (Rohm & Haas), CYGAL (American Cyanamide), ARMCO (Armco Composites), ARPOL (Ashland Chemical), CELANEX (Celanese Eng), RYNITE (DuPont), STYPOL (Freeman Chemical Corporation) and combinations thereof. The resins can also be functionalized, such as carboxylated, sulfonated, or the like, and particularly such as sodium sulfonated, if desired.

The low molecular weight amorphous resins, linear or branched, which are available from a number of sources, can possess various onset glass transition temperatures (™) of, for example, from about 40° C. to about 80° C., such as from about 50° C. to about 70° C., and from about 58° C. to about 62° C., as measured by differential scanning calorimetry (DSC). The linear and branched amorphous polyester resins, in embodiments, may be a saturated or unsaturated resin.

The low molecular weight linear amorphous polyester resins are generally prepared by the polycondensation of an organic diol, a diacid or diester, and a polycondensation catalyst. The low molecular weight amorphous resin is generally present in the toner composition in various suitable amounts, such as from about 60 to about 90 weight percent, or from about 50 to about 65 weight percent, of the toner or of the solids.

Examples of organic diols selected for the preparation of low molecular weight resins include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of diacid or diesters selected for the preparation of the low molecular weight amorphous polyester include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, dodecenylsuccinic acid, dodecenylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, dimethyl dodecenylsuccinate, and mixtures thereof. The organic diacid or diester is selected, for example, from about 45 to about 52 mole percent of the resin.

Examples of suitable polycondensation catalyst for either the low molecular weight amorphous polyester resin include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

The low molecular weight amorphous polyester resin may be a branched resin. As used herein, the terms "branched" or "branching" includes branched resin and/or cross-linked resins. Branching agents for use in forming these branched resins include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

Linear or branched unsaturated polyesters selected for the in situ pre-wise reactions between both saturated and unsaturated diacids (or anhydrides) and dihydric alcohols (glycols or diols). The resulting unsaturated polyesters are reactive (for example, crosslinkable) on two fronts: (i) unsaturation sites (double bonds) along the polyester chain, and (ii) functional groups such as carboxyl, hydroxy, and the like groups amenable to acid-base reactions. Typical unsaturated polyester resins are prepared by melt polycondensation or other polymerization processes using diacids and/or anhydrides and diols. Separation of the crosslinked polyester particles and process of the present disclosure include low molecular weight condensation polyesters which may be formed by the step In embodiments, the low molecular amorphous polyester resin or a combination of low molecular weight amorphous resins may have a glass transition temperature of from about 30° C. to about 80° C., in embodiments from about 35° C. to about 70° C. In further embodiments, the combined amorphous resins may have a melt viscosity of from about 10 to about 1,000,000 Pa*S at about 130° C., in embodiments from about 50 to about 100,000 Pa*S.

The monomers used in making the selected amorphous polyester resin are not limited, and the monomers utilized may include any one or more of, for example, ethylene, propylene, and the like. Known chain transfer agents, for example dodecanethiol or carbon tetrabromide, can be utilized to control the molecular weight properties of the polyester. Any suitable method for forming the amorphous or crystalline polyester from the monomers may be used without restriction.

The amount of the low molecular weight amorphous polyester resin in a toner particle of the present disclosure, whether in core, shell or both, may be present in an amount of from 25 to about 50 percent by weight, from about 30 to about 45 percent by weight, and from about 40 to about 45 percent by weight, of the toner particles (that is, toner particles exclusive of external additives and water).

Crystalline Polyester Resin

In embodiments, the toner composition includes at least one crystalline resin. As used herein, "crystalline" refers to a polyester with a three dimensional order. "Semicrystalline resins" as used herein refers to resins with a crystalline percentage of, for example, from about 10 to about 90%, and more specifically from about 12 to about 70%. Further, as used hereinafter "crystalline polyester resins" and "crystalline resins" encompass both crystalline resins and semicrystalline resins, unless otherwise specified.

In embodiments, the crystalline polyester resin is a saturated crystalline polyester resin or an unsaturated crystalline polyester resin.

The crystalline polyester resins, which are available from a number of sources, may possess various melting points of, for example, from about 30° C. to about 120° C., such as from about 50° C. to about 90° C. The crystalline resins may have, for example, a number average molecular weight ($M_n$), as measured by gel permeation chromatography (GPC) of, for example, from about 1,000 to about 50,000, such as from about 2,000 to about 25,000, from about 3,000 to about 15,000, and from about 6,000 to about 12,000. The weight average molecular weight ($M_W$) of the resin is 50,000 or less, for example, from about 2,000 to about 50,000, from about 3,000 to about 40,000, from about 10,000 to about 30,000 and from about 21,000 to about 24,000, as determined by GPC using polystyrene standards. The molecular weight distribution ($M_w/M_n$) of the crystalline resin is, for example, from about 2 to about 6, and more specifically, from about 2 to about 4. The crystalline polyester resins may have an acid value of about 2 to about 20 mg KOH/g, from about 5 to about 15 mg KOH/g and from about 8 to about 13 mg KOH/g. The acid value (or neutralization number) is the mass of potassium hydroxide (KOH) in milligrams that is required to neutralize one gram of the crystalline polyester resin.

Illustrative examples of crystalline polyester resins may include any of the various crystalline polyesters, such as polyethylene-adipate), poly(propylene-adipate), poly(butylene-adipate), poly(pentylene-adipate), poly(hexylene-adipate), poly(octylene-adipate), poly(ethylene-succinate), polypropylene-succinate), polybutylene-succinate), poly(pentylene-succinate), poly(hexylene-succinate), poly(octylene-succinate), poly(ethylene-sebacate), polypropylene-sebacate), polybutylene-sebacate), poly(pentylene-sebacate), poly(hexylene-sebacate), poly(octylene-sebacate), poly(nonylene-sebacate), poly(decylene-sebacate), poly(undecylene-sebacate), poly(dodecylene-sebacate), poly(ethylene-dodecanedioate), poly(propylene-dodecanedioate), poly(butylene-dodecanedioate), poly(pentylene-dodecanedioate), poly(hexylene-dodecanedioate), poly(octylene-dodecanedioate), poly(nonylene-dodecanedioate), poly(decylene-dodecandioate), poly(undecylene-dodecandioate), poly(dodecylene-dodecandioate), poly(ethylene-fumarate), poly(propylene-fumarate), poly(butylene-fumarate), poly(pentylene-fumarate), poly(hexylene-fumarate), poly(oetylene-fumarate), poly(nonylene-fumarate), poly(decylene-fumarate), copoly(5-sulfoisophthaloyl)-copoly(ethylene-adipate), copoly(5-sulfoisophthaloyl)-copoly(propylene-adipate), copoly(5-sulfoisophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfoisophthaloyl)-copoly(ethylene-succinate), copoly(5-sulfoisophthaloyl)-copoly(propylene-succinate), copoly(5-sulfoisophthaloyl)-copoly(butylene-succinate), copoly(5-sulfoisophthaloyl)-copoly(pentylene-succinate), copoly(5-sulfoisophthaloyl)-copoly(hexylene-succinate), copoly(5-sulfoisophthaloyl)-copoly(octylene-succinate), copoly(5-sulfo-isophthaloyl)-copoly(ethylene-sebacate), copoly(5-sulfo-isophthaloyl)-copoly(propylene-sebacate), copoly(5-sulfo-isophthaloyl)-copoly(butylenes-sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly(octylene-sebacate), copoly(5-sulfo-isophthaloyl)-copoly(ethylene-adipate), copoly(5-sulfo-isophthaloyl)-copoly(propylene-adipate), copoly(5-sulfa-isophthaloyl)-copoly(butylene-adipate), copoly(5-sulfo-isophthaloyl)-copoly(pentylene-adipate), copoly(5-sulfo-isophthaloyl)-copoly(hexylene-adipate) and combinations thereof.

The crystalline resin may be prepared by a polycondensation process by reacting suitable organic diol(s) and suitable organic diacid(s) in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and may be selected in an amount, for example, of from about 0.01 to about 1 mole percent of the resin. Additionally, in place of the organic diacid, an organic diester can also be selected, and where an alcohol byproduct is generated. In further embodiments, the crystalline polyester resin is a poly(dodecandioicacid-co-nonanediol.

Examples of organic diols selected for the preparation of crystalline polyester resins include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline polyester resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin.

Suitable crystalline polyester resins include those disclosed in U.S. Pat. No. 7,329,476 and U.S. Patent Application Pub. Nos. 2006/0216626, 2008/0107990, 2008/0236446 and 2009/0047593, each of which is hereby incorporated by reference in their entirety. In embodiments, a suitable crystalline resin may include a resin composed of ethylene glycol or nonanediol and a mixture of dodecanedioic acid and fumaric acid co-monomers with the following formula (I):

(I)

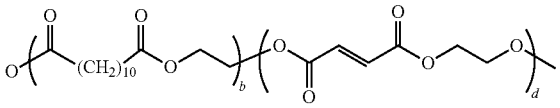

wherein b is from 5 to 2000 and d is from 5 to 2000.

If semicrystalline polyester resins are employed herein, the semicrystalline resin may include poly(3-methyl-1-butene), poly(hexamethylene carbonate), poly(ethylene-p-carboxy phenoxy-butyrate), poly(ethylene-vinyl acetate), poly(docosyl acrylate), poly(dodecyl acrylate), poly(octadecyl acrylate), poly(octadecyl methacrylate), poly(behenylpolyethoxyethyl methacrylate), poly(ethylene adipate), poly (decamethylene adipate), poly(decamethylene azelaate), poly(hexamethylene oxalate), poly(decamethylene oxalate), poly(ethylene oxide), polypropylene oxide), poly(butadiene oxide), poly(decamethylene oxide), poly(decamethylene sulfide), poly(decamethylene disulfide), poly(ethylene sebacate), poly(decamethylene sebacate), poly(ethylene suberate), poly(decamethylene succinate), poly(eicosamethylene malonate), poly(ethylene-p-carboxy phenoxy-undecanoate), poly(ethylene dithionesophthalate), poly(methyl ethylene terephthalate), poly(ethylene-p-carboxy phenoxy-valerate), poly(hexamethylene-4,4'-oxydibenzoate), poly(10-hydroxy capric acid), poly(isophthalaldehyde), poly(octamethylene dodecanedioate), poly(dimethyl siloxane), poly(dipropyl siloxane), poly(tetramethylene phenylene diacetate), poly (tetramethylene trithiodicarboxylate), poly(trimethylene dodecane dioate), poly(m-xylene), poly(p-xylylene pimelamide), and combinations thereof.

The amount of the crystalline polyester resin in a toner particle of the present disclosure, whether in core, shell or both, may be present in an amount of from 1 to about 15 percent by weight, from about 5 to about 10 percent by weight, and from about 6 to about 8 percent by weight, of the toner particles (that is, toner particles exclusive of external additives and water).

High Molecular Weight Polyester Resin

In embodiments, the resins described above may be combined with at least one high molecular weight branched or cross-linked amorphous polyester resin. This high molecular weight resin may include, in embodiments, for example, a branched amorphous resin or amorphous polyester, a cross-linked amorphous resin or amorphous polyester, or mixtures thereof, or a non-cross-linked amorphous polyester resin that has been subjected to cross-linking. In accordance with the present disclosure, from about 1% by weight to about 100% by weight of the high molecular weight amorphous polyester resin may be branched or cross-linked, in embodiments from about 2% by weight to about 50% by weight of the higher molecular weight amorphous polyester resin may be branched or cross-linked.

As used herein, the high molecular weight amorphous polyester resin may have, for example, a number average molecular weight ($M_n$), as measured by gel permeation chromatography (GPC) of, for example, from about 1,000 to about 10,000, such as from about 2,000 to about 8,000, from about 3,000 to about 8,000, and from about 6,000 to about 8,000. The weight average molecular weight ($M_w$) of the resin is greater than 55,000, for example, from about 55,000 to about 150,000, from about 50,000 to about 100,000, from about 63,000 to about 94,000 and from about 68,000 to about 85,000, as determined by GPC using polystyrene standard. The polydispersity index (PD) is above about 4, such as, for example, greater than about 4. in embodiments from about 4 to about 20, in other embodiments from about 6 to about 10, and from about 6 to about 8, as measured by GPC versus standard polystyrene reference resins. The PD index is the ratio of the weight-average molecular weight ($M_w$) and the number-average molecular weight ($M_n$). The low molecular weight amorphous polyester resins may have an acid value of about 8 to about 20 mg KOH/g, from about 8 to about 16 mg KOH/g and from about 11 to about 15 mg KOH/g. The high molecular weight amorphous polyester resins, which are available from a number of sources, can possess various melting points of for example, from about 30° C. to about 140° C., such as from about 75° C. to about 130° C., from about 100° C. to about 125° C., and from about 115° C. to about 121° C.

The high molecular weight amorphous resins, which are available from a number of sources, can possess various onset glass transition temperatures (™) of, for example, from about 40° C. to about 80° C., such as from about 50° C. to about 70° C., and from about 54° C. to about 68° C., as measured by differential scanning calorimetry (DSC). The linear and branched amorphous polyester resins, in embodiments, may be a saturated or unsaturated resin.

The high molecular weight amorphous polyester resins may prepared by branching or cross-linking linear polyester resins. Branching agents can be utilized, such as trifunctional or multifunctional monomers, which agents usually increase the molecular weight and polydispersity of the polyester. Suitable branching agents include glycerol, trimethylol ethane, trimethylol propane, pentaerythritol, sorbitol, diglycerol, trimellitic acid, trimellitic anhydride, pyromellitic acid, pyromellitic anhydride, 1,2,4-cyclohexanetricarboxylic acid, 2,5,7-naphthalenetricarboxylic acid, 1,2,4-butanetricarboxylic acid, combinations thereof, and the like. These branching agents can be utilized in effective amounts of from about 0.1 mole percent to about 20 mole percent based on the starting diacid or diester used to make the resin.

Compositions containing modified polyester resins with a polybasic carboxylic acid which may be utilized in forming high molecular weight polyester resins include those disclosed in U.S. Pat. No. 3,681,106, as well as branched or cross-linked polyesters derived from polyvalent acids or alcohols as illustrated in U.S. Pat. Nos. 4,863,825; 4,863,824; 4,845,006; 5,143,809; 5,057,596; 4,988,794; 4,981,939; 4,980,448; 4,933,252; 4,931,370; 4,917,983 and 4,973,539, the disclosures of each of which are incorporated by reference herein in their entirety.

In embodiments, cross-linked polyesters resins may be made from linear amorphous polyester resins that contain sites of unsaturation that can react under free-radical conditions. Examples of such resins include those disclosed in U.S. Pat. Nos. 5,227,460; 5,376,494; 5,480,756; 5,500,324; 5,601,960; 5,629,121; 5,650,484; 5,750,909; 6,326,119; 6,358,657; 6,359,105; and 6,593,053, the disclosures of each of which are incorporated by reference in their entirety. In embodiments, suitable unsaturated polyester base resins may be prepared from diacids and/or anhydrides such as, for example, maleic anhydride, terephthalic acid, trimelltic acid, fumaric acid, and the like, and combinations thereof, and diols such as, for example, bisphenol-A ethyleneoxide adducts, bisphenol A-propylene oxide adducts, and the like, and combinations thereof. In embodiments, a suitable polyester is poly (propoxylated bisphenol A co-fumaric acid).

In embodiments, a cross-linked branched polyester may be utilized as a high molecular weight amorphous polyester resin. Such polyester resins may be formed from at least two pre-gel compositions including at least one polyol having two or more hydroxyl groups or esters thereof, at least one aliphatic or aromatic polyfunctional acid or ester thereof, or a mixture thereof having at least three functional groups; and optionally at least one long chain aliphatic carboxylic acid or ester thereof, or aromatic monocarboxylic acid or ester thereof, or mixtures thereof. The two components may be reacted to substantial completion in separate reactors to produce, in a first reactor, a first composition including a pre-gel having carboxyl end groups, and in a second reactor, a second composition including a pre-gel having hydroxyl end groups. The two compositions may then be mixed to create a cross-linked branched polyester high molecular weight resin. Examples of such polyesters and methods for their synthesis include those disclosed in U.S. Pat. No. 6,592,913, the disclosure of which is hereby incorporated by reference in its entirety.

In embodiments, the cross-linked branched polyesters for the high molecular weight amorphous polyester resin may include those resulting from the reaction of dimethylterephthalate, 1,3-butanediol, 1,2-propanediol, and pentaerythritol.

Suitable polyols may contain from about 2 to about 100 carbon atoms and have at least two or more hydroxy groups, or esters thereof. Polyols may include glycerol, pentaerythritol, polyglycol, polyglycerol, and the like, or mixtures thereof. The polyol may include a glycerol. Suitable esters of glycerol include glycerol palmitate, glycerol sebacate, glycerol adipate, triacetin tripropionin, and the like. The polyol may be present in an amount of from about 20% to about 30% weight of the reaction mixture, in embodiments, from about 20% to about 26% weight of the reaction mixture.

Aliphatic polyfunctional acids having at least two functional groups may include saturated and unsaturated acids containing from about 2 to about 100 carbon atoms, or esters thereof, in some embodiments, from about 4 to about 20 carbon atoms. Other aliphatic polyfunctional acids include malonic, succinic, tartaric, malic, citric, fumaric, glutaric, adipic, pimelic, sebacic, suberic, azelaic, sebacic, and the like, or mixtures thereof. Other aliphatic polyfunctional acids which may be utilized include dicarboxylic acids containing a $C_3$ to $C_6$ cyclic structure and positional isomers thereof, and include cyclohexane dicarboxylic acid, cyclobutane dicarboxylic acid or cyclopropane dicarboxylic acid.

Aromatic polyfunctional acids having at least two functional groups which may be utilized include terephthalic, isophthalic, trimellitic, pyromellitic and naphthalene 1,4-, 2,3-, and 2,6-dicarboxylic acids.

The aliphatic polyfunctional acid or aromatic polyfunctional acid may be present in an amount of from about 40% to about 65% weight of the reaction mixture, in embodiments, from about 44% to about 60% weight of the reaction mixture.

Long chain aliphatic carboxylic acids or aromatic monocarboxylic acids may include those containing from about 12 to about 26 carbon atoms, or esters thereof, in embodiments, from about 14 to about 18 carbon atoms. Long chain aliphatic carboxylic acids may be saturated or unsaturated. Suitable saturated long chain aliphatic carboxylic acids may include lauric, myristic, palmitic, stearic, arachidic, cerotic, and the like, or combinations thereof. Suitable unsaturated long chain aliphatic carboxylic acids may include dodecylenic, palmitoleic, oleic, linoleic, linolenic, erucic, and the like, or combinations thereof. Aromatic monocarboxylic acids may include benzoic, naphthoic, and substituted napthoic acids. Suitable substituted naphthoic acids may include naphthoic acids substituted with linear or branched alkyl groups containing from about 1 to about 6 carbon atoms such as 1-methyl-2 naphthoic acid and/or 2-isopropyl-1-naphthoic acid. The long chain aliphatic carboxylic acid or aromatic monocarboxylic acids may be present in an amount of from about 0% to about 70% weight of the reaction mixture, in embodiments, of from about 15% to about 30% weight of the reaction mixture.

Additional polyols, ionic species, oligomers, or derivatives thereof, may be used if desired. These additional glycols or polyols may be present in amounts of from about 0% to about 50% weight percent of the reaction mixture. Additional polyols or their derivatives thereof may include propylene glycol, 1,3-butanediol, 1,3-propanediol, 1,4-butanediol, 1,6-hexanediol diethylene glycol, 1,4-cyclohexanediol, 1,4-cyclohexanedimethanol, neopentyl glycol, triacetin, trimethylolpropane, pentaerythritol, cellulose ethers, cellulose esters, such as cellulose acetate, sucrose acetate iso-butyrate and the like.

In embodiments, the high molecular weight resin, for example a branched polyester, may be present on the surface of toner particles of the present disclosure. The high molecular weight resin on the surface of the toner particles may also be particulate in nature, with high molecular weight resin particles having a diameter of from about 100 nanometers to about 300 nanometers, in embodiments from about 110 nanometers to about 150 nanometers.

The amount of high molecular weight amorphous polyester resin in a toner particle of the present disclosure, whether in the core, the shell, or both, may be from about 25% to about 50% by weight of the toner, in embodiments from about 30% to about 45% by weight, or from about 40% to about 45% by weight of the toner (that is, toner particles exclusive of external additives and water).

The ratio of crystalline resin to the low molecular weight amorphous resin to high molecular weight amorphous polyester resin can be in the range from about 1:1:98 to about 98:1:1 to about 1:98:1, such as from about 1:5:5 to about 1:9:9, such as from about 1:6:6 to about 1:8:8. However, amounts and ratios outside of these ranges can be used, in embodiments, depending upon the type and amounts of other materials present.

Biocides

The toner composition may also include at least one biocide. Polyester resins, such as those described above, have a pH of about 7-8, which makes these resins susceptible to bacterial/fungi attacks and various forms of bio-induced degradation. The inclusion of the at least one biocide in the toner composition acts to reduce or eliminate a potential over 20% degradation in molecular weight of the above described polyester resins that might occur in the absence of a biocide, provide increased shelf life of the polyester latex and toner and thus may achieve a lower minimum fixing temperature (MFT) and a wider fusing latitude. Furthermore, the inclusion of the biocide may also provide more bio-durable xerographic prints.

Examples of suitable biocides include, for example, sorbic acid, 1-(3-chloroallyl)-3,5,7-triaza-1-azoniaadamantane chloride, commercially available as DOWICIL 200 (Dow Chemical Company), vinylene-bis thiocyanate, commercially available as CYTOX 3711 (American Cyanamid Company), disodium ethylenebis-dithiocarbamate, commercially available as DITHONE D14 (Rohm & Haas Company), bis (trichloromethyl)sulfone, commercially available as BIOCIDE N-1386 (Stauffer Chemical Company), zinc pyridinethione, commercially available as zinc omadine (Olin Corporation), 2-bromo-t-nitropropane-1,3-diol, commercially available as ONYXIDE 500 (Onyx Chemical Company), BOSQUAT MB50 (Louza, Inc.), 2-bromo-t-nitropropane-1,3-diol, commercially available as PROXEL GXL (Arch Chem.), chlorinated and non-chlorinated isothiazolinones, commercially available as ACTICIDE CT and ACTICIDE LG (Thor Specialties, Inc), and the like. The biocide may be present in the toner composition in a concentration of about 250 parts per million (ppm) to about 1500 ppm, from about 500 ppm to about 1250 ppm and from about 750 ppm to about 1000 ppm.

Colorants

In embodiments, the toner compositions described herein also include a colorant. Any desired or effective colorant can be employed in the toner compositions, including dyes, pigments, mixtures thereof, and the like, provided that the colorant can be dissolved or dispersed in the ink carrier. Any dye or pigment may be chosen, provided that it is capable of being dispersed or dissolved in the ink carrier and is compatible with the other ink components. The ink compositions can be used in combination with conventional toner colorant materials, such as Color Index (C.I.) Solvent Dyes, Disperse Dyes, modified Acid and Direct Dyes, Basic Dyes, Sulphur Dyes, Vat Dyes, and the like. Examples of suitable dyes include Neozapon Red 492 (BASF); Orasol Red G (Ciba); Direct Brilliant Pink B (Oriental Giant Dyes); Direct Red 3BL (Classic Dyestuffs); Supranol Brilliant Red 3BW (Bayer AG); Lemon Yellow 6G (United Chemie); Light Fast Yellow 3G (Shaanxi); Aizen Spilon Yellow C-GNH (Hodogaya Chemical); Bernachrome Yellow GD Sub (Classic Dyestuffs); Cartasol Brilliant Yellow 4GF (Clariant); Cibanon Yellow 2GN (Ciba); Orasol Black CN (Ciba); Savinyl Black RLSN (Clariant); Pyrazol Black BG (Clariant); Morfast Black 101 (Rohm & Haas); Diaazol Black BG (ICI); Orasol Blue GN (Ciba); Savinyl Blue GLS (Clariant); Luxol Fast Blue MBSN (Pylam Products); Sevron Blue 5GMF (Classic Dyestuffs); Basacid Blue 750 (BASF), Neozapon Black X51 (BASF), Classic Solvent Black 7 (Classic Dyestuffs), Sudan Blue 670 (C.I. 61554) (BASF), Sudan Yellow 146 (C.I. 12700) (BASF), Sudan Red 462 (C.I. 26050) (BASF), C.I. Disperse Yellow 238, Neptune Red Base NB543 (BASF, C.I. Solvent Red 49), Neopen Blue FF-4012 from BASF, Lampronol Black BR from ICI (C.I. Solvent Black 35), Morton Morplas Magenta 36 (CA. Solvent Red 172), metal phthalocyanine colorants such as those disclosed in U.S. Pat. No. 6,221,137, the disclosure of which is totally incorporated herein by reference, and the like. Polymeric dyes can also be used, such as those disclosed in, for example, U.S. Pat. Nos. 5,621,022 and 5,231,135, the disclosures of each of which are herein entirely incorporated herein by reference, and commercially available from, for example, Milliken & Company as Milliken Ink Yellow 869, Milliken Ink Blue 92, Milliken Ink Red 357, Milliken Ink Yellow 1800, Milliken Ink Black 8915-67, uncut Reactant Orange X-38, uncut Reactant Blue X-17, Solvent Yellow 162, Acid Red 52, Solvent Blue 44, and uncut Reactant Violet X-80.

Pigments are also suitable colorants for the toner composition described herein. Examples of suitable pigments include PALIOGEN Violet 5100 (commercially available from BASF); PALIOGEN Violet 5890 (commercially available from BASF); HELIOGEN Green L8730 (commercially available from BASF); LITHOL Scarlet D3700 (commercially available from BASF); SUNFAST Blue 15:4 (commercially available from Sun Chemical); Hostaperm Blue 132G-D (commercially available from Clariant); Hostaperm Blue B4G (commercially available from Clariant); Permanent Red P-F7RK; Hostaperm Violet BL (commercially available from Clariant); LITHOL Scarlet 4440 (commercially available from BASF); Bon Red C (commercially available from Dominion Color Company); ORACET Pink RF (commercially available from Ciba); PALIOGEN Red 3871 K (commercially available from BASF); SUNFAST Blue 15:3 (commercially available from Sun Chemical); PALIOGEN Red 3340 (commercially available from BASF); SUNFAST Carbazole Violet 23 (commercially available from Sun Chemical); LITHOL Fast Scarlet L4300 (commercially available from BASF); SUNBRITE Yellow 17 (commercially available from Sun Chemical); HELIOGEN Blue L6900, L7020 (commercially available from BASF); SUNBRITE Yellow 74 (commercially available from Sun Chemical); SPECTRA PAC C Orange 16 (commercially available from Sun Chemical); HELIOGEN Blue K6902, K6910 (commercially available from BASF); SUNFAST Magenta 122 (commercially available from Sun Chemical); HELIOGEN Blue D6840, D7080 (commercially available from BASF); Sudan Blue OS (commercially available from BASF); NEOPEN Blue FF4012 (commercially available from BASF); PV Fast Blue B2GO1 (commercially available from Clariant); IRGALITE Blue BCA (commercially available from Ciba); PALIOGEN Blue 6470 (commercially available from BASF); Sudan Orange G (commercially available from Aldrich), Sudan Orange 220 (commercially available from BASF); PALIOGEN Orange 3040 (BASF); PALIOGEN Yellow 152, 1560 (commercially available from BASF); LITHOL Fast Yellow 0991 K (commercially available from BASF); PALIOTOL Yellow 1840 (commercially available from BASF); NOVOPERM Yellow FGL (commercially available from Clariant); Ink Jet Yellow 4G VP2532 (commercially available from Clariant); Toner Yellow HG (commercially available from Clariant); Lumogen Yellow D0790 (commercially available from BASF); Suco-Yellow L1250 (commercially available from BASF); Suco-Yellow D1355 (commercially available from BASF); Suco Fast Yellow D1355, D1351 (commercially available from BASF); HOSTAPERM Pink E 02 (commercially available from Clariant); Hansa Brilliant Yellow 5GX03 (commercially available from Clariant); Permanent Yellow GRL 02 (commercially available from Clariant); Permanent Rubine L6B 05 (commercially available from Clariant); FANAL Pink D4830 (commercially available from BASF); CINQUASIA Magenta (commercially available from DU PONT); PALIOGEN Black L0084 (commercially available from BASF); Pigment Black K801 (commercially available from BASF); and carbon blacks such as REGAL 330™ (commercially available from Cabot), Nipex 150 (commercially available from Degusssa) Carbon Black 5250 and Carbon Black 5750 (commercially available from Columbia Chemical), and the like, as well as mixtures thereof.

Also suitable are the colorants disclosed in U.S. Pat. Nos. 6,472,523, 6,726,755, 6,476,219, 6,576,747, 6,713,614, 6,663,703, 6,755,902, 6,590,082, 6,696,552, 6,576,748, 6,646,111, 6,673,139, 6,958,406, 6,821,327, 7,053,227, 7,381,831 and 7,427,323, the disclosures of each of which are incorporated herein by reference in their entirety.

In embodiments, solvent dyes are employed. An example of a solvent dye suitable for use herein may include spirit soluble dyes because of their compatibility with the ink carriers disclosed herein. Examples of suitable spirit solvent dyes include Neozapon Red 492 (BASF); Orasol Red G (Ciba); Direct Brilliant Pink B (Global Colors); Aizen Spilon Red C-BH (Hodogaya Chemical); Kayanol Red 3BL (Nippon Kayaku); Spirit Fast Yellow 3G; Aizen Spilon Yellow C-GNH (Hodogaya Chemical); Cartasol Brilliant Yellow 4GF (Clariant); Pergasol Yellow CGP (Ciba); Orasol Black RLP (Ciba); Savinyl Black RLS (Clariant); Morfast Black Conc. A (Rohm and Haas); Orasol Blue GN (Ciba); Savinyl Blue GLS (Sandoz); Luxol Fast Blue MBSN (Pylam); Sevron Blue 5GMF (Classic Dyestuffs); Basacid Blue 750 (BASF), Neozapon Black X51 [C.I. Solvent Black, C.I. 12195] (BASF), Sudan Blue 670 [C.I. 61554] (BASF), Sudan Yellow 146 [C.I. 12700] (BASF), Sudan Red 462 [C.I. 260501] (BASF), mixtures thereof and the like.

The amount of colorant in a toner particle of the present disclosure, whether in the core, the shell, or both, may be from 1% to about 15% by weight of the toner, in embodiments from about 5% to about 15% by weight, or from about 5% to about 10% by weight of the toner (that is, toner particles exclusive of external additives and water).

Surface Additives

The toner may also include any suitable surface additives. Examples of surface additives are surface treated fumed silicas, for example RY-50 from Nippon Aerosil, comprised of hydrophobic silica coated with dimethylsiloxane, TS-530 from Cabosil Corporation, with an 8 nanometer particle size and a surface treatment of hexamethyldisilazane; NAX50 silica, obtained from DeGussa/Nippon Aerosil Corporation, coated with HMDS; DTMS silica, obtained from Cabot Corporation, comprised of a fumed silica silicon dioxide core L90 coated with DTMS; H2050EP, obtained from Wacker Chemie, coated with an amino functionalized organopolysiloxane; metal oxides such as $TiO_2$, for example MT-3103 from Tayca Corp. with a 16 nanometer particle size and a surface treatment of decylsilane; SMT5103, obtained from Tayca Corporation, comprised of a crystalline titanium dioxide core MT500B coated with DTMS (decyltrimethoxysilane); P-25 from Degussa Chemicals with no surface treatment; alternate metal oxides such as aluminum oxide, and as a lubricating agent, for example, stearates or long chain alcohols, such as UNILIN 700™, and the like. In general, silica is applied to the toner surface for toner flow, tribo enhancement, admix control, improved development and transfer stability, and higher toner blocking temperature. $TiO_2$ is applied for improved relative humidity (RH) stability, tribo control and improved development and transfer stability. Examples of suitable $SiO_2$ and $TiO_2$ are those surface treated with compounds including DTMS (decyltrimethoxysilane) or HMDS (hexamethyldisilazane).

The $SiO_2$ and $TiO_2$ may generally possess a primary particle size greater than approximately 30 nanometers, or at least 40 nanometers, with the primary particles size measured by, for instance, transmission electron microscopy (TEM) or calculated (assuming spherical particles) from a measurement of the gas absorption, or BET, surface area. $TiO_2$ is found to be especially helpful in maintaining development and transfer over a broad range of area coverage and job run length. The $SiO_2$ and $TiO_2$ are more specifically applied to the toner surface with the total coverage of the toner ranging from, for example, about 140 to about 200 percent theoretical surface area coverage (SAC), where the theoretical SAC (hereafter referred to as SAC) is calculated assuming all toner particles are spherical and have a diameter equal to the volume median diameter of the toner as measured in the standard Coulter Counter method, and that the additive particles are distributed as primary particles on the toner surface in a hexagonal closed packed structure. Another metric relating to the amount and size of the additives is the sum of the "SAC× Size" (surface area coverage times the primary particle size of the additive in nanometers) for each of the silica and titania particles, or the like, for which all of the additives should, more specifically, have a total SAC×Size range of, for example, about 4,500 to about 7,200. The ratio of the silica to titania particles is generally from about 50 percent silica/50 percent titania to about 85 percent silica/15 percent titania (on a weight percentage basis).

Calcium stearate and zinc stearate can be selected as an additive for the toners of the present invention in embodiments thereof, the calcium and zinc stearate primarily providing lubricating properties. Also, the calcium and zinc stearate can provide developer conductivity and tribo enhancement, both due to its lubricating nature. In addition, calcium and zinc stearate enables higher toner charge and charge stability by increasing the number of contacts between toner and carrier particles. A suitable example is a commercially available calcium and zinc stearate with greater than about 85 percent purity, for example from about 85 to about 100 percent pure, for the 85 percent (less than 12 percent calcium oxide and free fatty acid by weight, and less than 3 percent moisture content by weight) and which has an average particle diameter of about 7 microns and is available from Ferro Corporation (Cleveland, Ohio). Examples are SYNPRO® Calcium Stearate 392A and SYNPRO® Calcium Stearate NF Vegetable or Zinc Stearate-L. Another example is a commercially available calcium stearate with greater than 95 percent purity (less than 0.5 percent calcium oxide and free fatty acid by weight, and less than 4.5 percent moisture content by weight), and which stearate has an average particle diameter of about 2 microns and is available from NOF Corporation (Tokyo, Japan). In embodiments, the toners contain from, for example, about 0.1 to about 5 weight percent titania, about 0.1 to about 8 weight percent silica, or from about 0.1 to about 4 weight percent calcium or zinc stearate.

Wax

A wax may also be combined with the polyester resin(s), colorant and in forming toner particles. When included, the wax may be present, either in the core, shell or both, in an amount of, for example, from about 1 weight percent to about 15 weight percent of the toner particles, in embodiments from about 5 weight percent to about 15 weight percent and from about 5 to about 15 weight percent of the toner particle.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX polyethylene waxes from Baker Petrolite, wax emulsions available from Michaelman, Inc. and the Daniels Products Company, EPOLENE N-15 commercially available from Eastman Chemical Products, Inc., and VISCOL 550-P, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550, SUPERSLIP 6530 available from Micro Powder Inc., fluorinated waxes, for example POLYFLUO 190, POLYFLUO 200, POLYSILK 19, POLYSILK 14 available from Micro Powder Inc., mixed fluorinated, amide waxes, for example MICROSPERSION 19 also available from Micro Powder Inc., imides, esters, quaternary amines, carboxylic acids or acrylic polymer emulsion, for example JONCRYL 74, 89, 130, 537, and 538, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

To incorporate the wax into the toner, it is desirable for the wax to be in the form of one or more aqueous emulsions or dispersions of solid wax in water, where the solid wax particle size is usually in the range of from about 100 to about 300 nm.

Initiators

In embodiments, the toner particles described herein may be curable upon exposure to UV radiation, for example, where the low molecular weight amorphous polyester resin, the high molecular weight amorphous polyester resin and/or crystalline polyester resin includes unsaturated moieties as described above. In such embodiments, the toner may further include suitable photoinitiators, such as UV-photoinitiators including, for example, hydroxycyclohexylphenyl ketones; other ketones such as alpha-amino ketone and 4-(2-hydroxyethoxy)phenyl-(2-hydroxy-2-propyl) ketone; benzoins; benzoin alkyl ethers; benzophenones, such as 2,4,6-trimethylbenzophenone and 4-methylbenzophenone; trimethylbenzoylphenylphosphine oxides such as 2,4,6-trimethylbenzoyl-diphenyl-phosphine oxide or phenylbis(2,4,6-trimethylvbenzyoyl) phosphine oxide (BAPO) available as IRGACURE 819 from Ciba; azo compounds; anthraquinones and substituted anthraquinones, such as, for example, alkyl substituted or halo substituted anthraquinones; other substituted or unsubstituted polynuclear quinines; acetophenones, thioxanthones; ketals; acylphosphines; and mixtures thereof. Other examples of photoinitiators include, but not limited to, 2-hydroxy-2-methyl-1-phenyl-propan-1-one and 2-isopropyl-9H-thioxanthen-9-one. In embodiments, the photoinitiator is one of the following compounds or a mixture thereof: a hydroxycyclohexylphenyl ketone, such as, for example, 2-hydroxy-4'-hydroxyethoxy-2-methylpropiophenone or 1-hydroxycyclohexylphenyl ketone, such as, for example, IRGACURE® 184 (Ciba-Geigy Corp Tarrytown, N.Y.), having the structure:

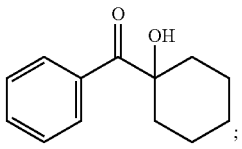

;

a trimethylbenzoylphenylphosphine oxide, such as, for example, ethyl-2,4,6-trimethylbenzoylphenylphosphinate, such as, for example, LUCIRIN® TPO-L (BASF Corp.), having the formula

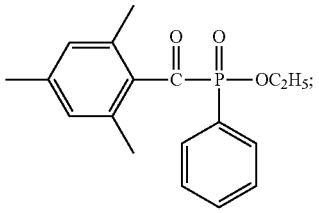

a mixture of 2,4,6-trimethylbenzophenone and 4-methylbenzophenone, such as, for example, SARCURE® SR1137 (Sartomer); a mixture of 2,4,6-trimethylbenzoyl-diphenyl-phosphine oxide and 2-hydroxy-2-methyl-1-phenyl-propan-1-one, such as, for example, DAROCUR® 4265 (Ciba Specialty Chemicals); alpha-amino ketone, such as, for example, IRGACURE® 379 (Ciba Specialty Chemicals); 4-(2-hydroxyethoxy)phenyl-(2-hydroxy-2-propyl) ketone, such as, for example, IRGACURE® 2959 (Ciba Specialty Chemicals); 2-isopropyl-9H-thioxanthen-9-one, such as, for example, DAROCUR® TTX (Ciba Specialty Chemicals); and mixtures thereof.

In embodiments, the toner composition may contain from about 0.5 to about 15 wt % photoinitiator, such as UV-photo initiator, such as from about 1 to about 15 wt %, or from about 3 to about 12 wt %, photoinitiator such as UV-photoinitiator. Of course, other amounts can be used as desired.

In embodiments, the toner composition may also include any suitable free radical polymerization initiators. The free radical initiator can be any free radical polymerization initiator capable of initiating a free radical polymerization process, and mixtures thereof, typically free radical initiators capable of providing free radical species upon heating to above about 30° C.

Although water soluble free radical initiators that are traditionally used in emulsion polymerization reactions are typically selected, it is also within the scope of the present disclosure that other free radical initiators are employed. Examples of suitable free radical initiators include, but are not limited to, peroxides such as ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, sodium persulfate, potassium persulfate, diisopropyl peroxycarbonate, tetralin hydroperoxide, 1-phenyl-2-methylpropyl-1-hydroperoxide, tert-butylhydroperoxide pertriphenylacetate, tert-butyl performate, tert-butyl peracetate, tert-butyl perbenzoate, tert-butyl perphenylacetate, tert-butyl permethoxyacetate, and tert-butyl per-N-(3-toluoyl)carbamate; azo compounds such as 2,2'-azobispropane, 2,2'-dichloro-2,2'-azobispropane, 1,1'-azo(methylethyl) diacetate, 2,2'-azobis(2-amidinopropane)hydrochloride, 2,2'-azobis(2-amidinopropane)-nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonod-initrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'- azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1'-azobis-1,2-diphenylethane, poly(bisphenol A-4, 4'-azobis-4-cyanopentano-ate), and poly(tetraethylene glycol-2,2'-azobisisobutyrate); and 1,4-bis(pentaethylene)-2-tetrazene, and 1,4-dimethoxycarbonyl-1,4-dipheny-1-2-tetrazene; and the like; and the mixture thereof.

More typical free radical initiators include, but are not limited to, ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, sodium persulfate, potassium persulfate, diisopropyl peroxycarbonate and the like.

Developer Composition (with Carrier)

The toner particles of the disclosure can optionally be formulated into a developer composition by mixing the toner particles with carrier particles. Illustrative examples of carrier particles that can be selected for mixing with the toner composition prepared in accordance with the present disclosure include those particles that are capable of triboelectrically obtaining a charge of opposite polarity to that of the toner particles. Accordingly, in one embodiment the carrier particles may be selected so as to be of a negative polarity in order that the toner particles that are positively charged will adhere to and surround the carrier particles. Illustrative examples of such carrier particles include iron, iron alloys, steel, nickel, iron ferrites, including ferrites that incorporate strontium, magnesium, manganese, copper, zinc, and the like, magnetites, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of acrylic and methacrylic polymers, such as methyl methacrylate, acrylic and methacrylic copolymers with fluoropolymers or with monoalkyl or dialkylamines, fluoropolymers, polyolefins, polystyrenes, such as polyvinylidene fluoride resins, terpolymers of styrene, methyl methacrylate, and a silane, such as triethoxy silane, tetrafluoroethylenes, other known coatings and the like.

The carrier particles can be mixed with the toner particles in various suitable combinations. The toner concentration is usually about 2 to about 10 percent by weight of toner and about 90 to about 98 percent by weight of carrier. However, different toner and carrier percentages may be used to achieve a developer composition with desired characteristics.

Preparation of Polyester Resin Emulsion

An example of a method for generating a resin emulsion for the production of toner particles having polyester resin(s) is disclosed in U.S. Pat. No. 7,029,817, which is incorporated herein in its entirety by reference. Emulsion aggregation toner dispersions may be generated by other processes including, but not limited to, the melt mixing process disclosed in U.S. Patent Application Pub. No. 2006/0223934, which is incorporated herein in its entirety by reference, and the phase inversion process described in U.S. Patent Application Publication No. 2008/0236446, which is incorporated herein by reference in its entirety.

The toner particles may be created by the emulsion aggregation (EA) process, which are illustrated in a number of patents, such as U.S. Pat. Nos. 5,593,807, 5,290,654, 5,308,734, and 5,370,963, each of which are incorporated herein by reference in their entirety.

In embodiments, toner compositions may be prepared by any of the known emulsion-aggregation processes, such as a phase inversion emulsification (PIE) or solvent flash process described below. The PIE process includes aggregating a mixture of a colorant, a biocide and any other desired or required additives, and an emulsion comprising a low molecular weight amorphous polyester resin, a high molecular weight polyester resin and the crystalline polyester resin, and then coalescing the aggregate mixture. This composition, referred to herein as the "pre-toner mixture", may be prepared by dissolving the crystalline polyester resin and the high molecular weight and low molecular weight amorphous polyester resin in a suitable solvent. In embodiments, the resin emulsion is prepared by dissolving a polyester resin in a solvent.

Suitable solvents include alcohols, ketones, esters, ethers, chlorinated solvents, nitrogen containing solvents and mixtures thereof. Specific examples of suitable solvents include isopropyl alcohol, acetone, methyl acetate, methyl ethyl ketone, tetrahydrofuran, cyclohexanone, ethyl acetate, N,N dimethylformamide, dioctyl phthalate, toluene, xylene, benzene, dimethylsulfoxide, mixtures thereof, and the like. If desired or necessary, the resins can be dissolved in the one or more of the above solvents at an elevated temperature of from about 40° C. to about 80° C., such as from about 50° C. to about 70° C. or from about 60° C. to about 65° C., although the temperature is desirably lower than the glass transition temperature of the wax and resin. In embodiments, the resin is dissolved in the solvent at an elevated temperature, but below the boiling point of the solvent, such as from about 2° C. to about 15° C. or from about 5° C. to about 10° C. below the boiling point of the solvent.

After being dissolved in a solvent, the above dissolved resins are mixed into an emulsion medium, for example water, such as deionized water optionally containing a stabilizer, and optionally a surfactant.

Examples of suitable stabilizers include water-soluble alkali metal hydroxides, such as sodium hydroxide, potassium hydroxide, lithium hydroxide, beryllium hydroxide, magnesium hydroxide, calcium hydroxide, or barium hydroxide; ammonium hydroxide; alkali metal carbonates, such as sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; or mixtures thereof. In embodiments, a particularly desirable stabilizer is sodium bicarbonate or ammonium hydroxide. When the stabilizer is used in the composition, the stabilizer neutralizes any acidic groups on the polyester resins. The stabilizer is typically present in amounts of from about 0.1 percent to about 5 percent, such as from about 0.5 percent to about 3 percent, by weight of the resin. When such salts are added to the composition as a stabilizer, it is desired in embodiments that incompatible metal salts are not present in the composition. For example, when these salts are used, the composition should be completely or essentially free of zinc and other incompatible metal ions, for example, Ca, Fe, Ba, etc., that form water-insoluble salts. The term "essentially free" refers, for example, to the incompatible metal ions as present at a level of less than about 0.01 percent, such as less than about 0.005 percent or less than about 0.001 percent, by weight of the wax and resin. If desired or necessary, the stabilizer can be added to the mixture at ambient temperature, or it can be heated to the mixture temperature prior to addition.

Surfactant

Optionally, an additional stabilizer such as a surfactant may be added to the aqueous emulsion medium such as to afford additional stabilization to the resin(s). One, two, or more surfactants may be utilized. The surfactants may be selected from ionic surfactants and nonionic surfactants. Anionic surfactants and cationic surfactants are encompassed by the term "ionic surfactants." In embodiments, the use of anionic and nonionic surfactants can additionally help stabilize the aggregation process in the presence of the coagulant, which otherwise could lead to aggregation instability.

In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc as IGEPAL CA210™, IGEPAL CA-520™, IGEPAL CA-720™, IGEPAL CO-890™, IGEPAL CO-720™, IGEPAL CO-290™, IGEPAL CA210™, ANTAROX 890™ and ANTAROX 897™, Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, and acids such as abitic acid, which may be obtained from Aldrich, or NEOGEN R™, NEOGEN SC™, NEOGEN RK™ which may be obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

After the stabilizer or stabilizers are added, the resultant mixture can be mixed or homogenized for any desired time. Additionally, in embodiments, the pre-toner mixture optionally may be homogenized. If the pre-toner mixture is homogenized, homogenization may be accomplished by mixing at from about 600 to about 4,000 revolutions per minute. Homogenization may be accomplished by any suitable means, including, for example, an IKA ULTRA TURRAX T50 probe homogenizer.

In embodiments, the pH of the pre-toner mixture is adjusted to from about 2.5 to about 4. The pH of the pre-toner mixture may be adjusted by an acid such as, for example, acetic acid, nitric acid or the like.

Following the preparation of the pre-toner mixture, an aggregate mixture is formed by adding at least one aggregating agent (coagulant) to the pre-toner mixture. The aggregating agent is generally an aqueous solution of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof.

In embodiments, the aggregating agent may be added to the pre-toner mixture at a temperature that is below the glass transition temperature ($T_g$) of the emulsion resins. In some embodiments, the aggregating agent may be added in an amount of from about 30 to about 400 ppm, from about 40 to about 200 ppm and from about 50 to about 100 ppm, with respect to the weight of toner. The aggregating agent may be added to the pre-toner mixture over a period of from about 0 to about 60 minutes. Aggregation may be accomplished with or without maintaining homogenization. Aggregation is accomplished at temperatures that are may be greater than about 60° C.

After completion of the aggregation, a shell may coated on the toner particles. In embodiments, the crystalline polyester resin, the low molecular weight polyester resin, and the high molecular weight resin, for example a branched polyester, may be present on the surface of toner particles of the present disclosure in the form of a shell. The surface of the toner particles may also be particulate in nature, with each of the above resin particles having a diameter of from about 100 nanometers to about 300 nanometers, in embodiments from about 110 nanometers to about 150 nanometers. The above resins, alone or in combination, may cover from about 10% to about 90% of the toner surface, in embodiments from about 20% to about 50% of the toner surface. Additional components such as waxes and colorants may also be included in the shell.

In embodiments, resins which may be utilized to form a shell include the high molecular weight resin described above, and/or the amorphous polyester resins and crystalline polyester resins described above for use as the core. In embodiments, an amorphous or crystalline resin that may be utilized to form a shell in accordance with the present disclosure includes an amorphous polyester, optionally in combination with a high molecular weight resin latex described above. Multiple polyester resins may be combined together as a binder for the toner particles and may be utilized in any suitable amounts.

In embodiments, the low molecular weight amorphous polyester resin may be present in an amount of from about 20 percent by weight to about 100 percent by weight of the total shell resin, in embodiments from about 30 percent by weight to about 90 percent by weight of the total shell resin. Thus, in embodiments, the high molecular weight amorphous polyester resin may be present in the shell resin in an amount of from about 0 percent by weight to about 80 percent by weight of the total shell resin, in embodiments from about 10 percent by weight to about 70 percent by weight of the shell resin.

Next, the mixture is heated to flash off the solvent, and then cooled to room temperature. For example, the solvent flashing can be conducted at any suitable temperature above the boiling point of the solvent in water that will flash off the solvent, such as a temperature of from about 60° C. to about 100° C., such as from about 70° C. to about 90° C. or about 80° C., although the temperature may be adjusted based on, for example, the particular wax, resin, and solvent used.

Following the solvent flash step, the polyester resin emulsion may have an average particle diameter in the range of from about 100 to about 500 nanometers, such as from about 130 to about 300 nanometers as measured with a Honeywell MICROTRAC® UPA150 particle size analyzer.

Thus, the process calls for blending the crystalline polyester resin, the low molecular weight amorphous polyester resin, the high molecular weight amorphous polyester resin, together in the presence of a colorant, a biocide and a wax, and optionally other additives, heating the blend from room temperature to about 60° C. The temperature may be slowly raised to 65° C. and held there for from about 3 hours to about 9 hours, such as about 6 hours, in order to provide aggregated particles with an average size of from about 6 microns to about 12 microns, such as about 9 micron particles, that the have a shape factor of, for example, about 115 to about 130 as measured on the FPIA SYSMEX analyzer.

Following aggregation, the aggregates may be coalesced. Coalescence may be accomplished by heating the aggregate mixture to a temperature that is about 5° C. to about 20° C. above the $T_g$ of the crystalline and/or amorphous polyester resins. Generally, the aggregated mixture is heated to a temperature of about 50° C. to about 80° C. In embodiments, the mixture may also be stirred at from about 200 to about 750 revolutions per minute to coalesce the particles. Coalescence may be accomplished over a period of from about 3 to about 9 hours.

Optionally, during coalescence, the particle size of the toner particles may be controlled and adjusted to a desired size by adjusting the pH of the mixture. Generally, to control the particle size, the pH of the mixture is adjusted to between about 5 to about 7 using a base such as, for example, sodium hydroxide.

Furthermore during coalescence, an organic or inorganic complexing agent (sequestering agent) may be added to the toner composition to remove any unreacted coagulant. Examples of the organic complexing agent may include, for example, ethylenediaminetetraacetic acid (EDTA), gluconal, sodium gluconate, potassium citrate, sodium citrate, nitrotriacetate salt, humic acid and fulvic acid. Examples of the inorganic complexing agent include sodium silicate, potassium silicate, magnesium sulfate silicate and the like.

After coalescence, the mixture may be cooled to room temperature. After cooling, the mixture of toner particles or combined with of some embodiments may be washed with water and then dried, Drying may be accomplished by any suitable method for drying including freeze drying such that the moisture content of the toner particles is below about 1.2%. Freeze drying is typically accomplished at temperatures of about −80° C. for a period of about 72 hours.

Upon aggregation and coalescence, the toner particles of embodiments have an average particle size of from about 1 to about 15 microns, in further embodiments of from about 4 to about 15 microns, and, in particular embodiments, of from about 6 to about 11 microns, such as about 7 microns. The toner particles of the present disclosure also can have a size such that the upper geometric standard deviation (GSD) by volume is in the range of from about 1.15 to about 1.30, such as from about 1.18 to about 1.22, or less than 1.25. These GSD values for the toner particles of the present disclosure indicate that the toner particles are made to have a very narrow particle size distribution.

A shape factor is also a control process parameter associated with the toner being able to achieve optimal machine performance. The toner particles can have a shape factor of about 105 to about 170, such as about 110 to about 160, SF1*a. Scanning electron microscopy (SEM) is used to determine the shape factor analysis of the toners by SEM and image analysis (IA) is tested. The average particle shapes are quantified by employing the following shape factor (SF1*a) formula: SF1*a=100.pi.d.sup.2/(4A), where A is the area of the particle and d is its major axis. A perfectly circular or spherical particle has a shape factor of exactly 100. The shape factor SF1*a increases as the shape becomes more irregular or elongated in shape with a higher surface area. In addition to measuring shape factor SF, another metric to measure particle circularity is being used on a regular bases. This is a faster method to quantify the particle shape. The instrument used is an FPIA-2100 manufactured by Sysmex. For a completely circular sphere the circularity would be 1.000. The toner particles can have circularity of about 0.920 to 0.990 and, such as from about 0.950 to about 0.985.

In embodiments, the process may include the use of surfactants, emulsifiers, and other additives such as those discussed above. Likewise, various modifications of the above process will be apparent and are encompassed herein.

The toner particles described herein may further include other components, such as colorants, and various external additives.

Image Development Processes

Toners of the disclosure can be used in known electrostatographic imaging methods. Thus, for example, the toners can be charged, for example, triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll.

In embodiments, any known type of image development system may be used in an image developing device, including, for example, magnetic brush development, jumping single-component development, hybrid scavengeless development (HSD), etc. These development systems are well known in the art, and further explanation of the operation of these devices to form an image is thus not necessary herein.

In an image forming process, an image forming device is used to form a print, typically a copy of an original image. An image forming device imaging member (for example, a photoconductive member) including a photoconductive insulating layer on a conductive layer, is imaged by first uniformly electrostatically charging the surface of the photoconductive insulating layer. The member is then exposed to a pattern of activating electromagnetic radiation, for example light, which selectively dissipates the charge in the illuminated areas of the photoconductive insulating layer while leaving behind an electrostatic latent image in the non-illuminated areas. This electrostatic latent image may then be developed to form a visible image by depositing the toner particles, for example from a developer composition, on the surface of the photoconductive insulating layer. A development system be suitable for use herein may be a conductive magnetic brush development system. In embodiments, a CMB developer can be used in various systems, for example a semiconductive magnetic brush development system, which uses a semiconductive carrier. A semi-conductive magnetic brush development (SCMB) system, which uses semiconductive carriers, advances the developer material into contact with the electrostatic latent image. When the developer material is placed in a magnetic field, the carrier granules (particles) with the toner particles thereon form what is known as a magnetic brush? wherein the carrier beads form relatively long chains, which resemble the fibers of a brush. This magnetic brush is typically created by means of a developer roll in the form of a cylindrical sleeve rotating around a fixed assembly of permanent magnets. The carrier granules form chains extending from the surface of the cylindrical sleeve. The toner particles are electrostatically attracted to the chains of carrier granules. The rotation of the sleeve transports magnetically adhered developer material comprising carrier granules and toner particles and allows direct contact between the developer brush and a belt having a photoconductive surface. The electrostatic latent image attracts the toner particles from the carrier granules forming a toner power image on the photoconductive surface of the belt.

The resulting visible toner image can be transferred to a suitable image receiving substrate such as paper and the like.

To fix the toner to the image receiving substrate, such as a sheet of paper or transparency, hot roll fixing is commonly used. In this method, the image receiving substrate with the toner image thereon is transported between a heated fuser member and a pressure member with the image face contacting the fuser member. Upon contact with the heated fuser member, the toner melts and adheres to the image receiving medium, forming a fixed image. This fixing system is very advantageous in heat transfer efficiency and is especially suited for high speed electrophotographic processes.

The fuser member suitable for use herein comprises at least a substrate and an outer layer. Any suitable substrate can be selected for the fuser member. The fuser member substrate may be a roll, belt, flat surface, sheet, film, drelt (a cross between a drum or a roller), or other suitable shape used in the fixing of thermoplastic toner images to a suitable copy substrate. Typically, the fuser member is a roll made of a hollow cylindrical metal core, such as copper, aluminum, stainless steel, or certain plastic materials chosen to maintain rigidity and structural integrity, as well as being capable of having a polymeric material coated thereon and adhered finely thereto. The supporting substrate may be a cylindrical sleeve, preferably with an outer fluoropolymeric layer of from about 1 to about 6 millimeters. In one embodiment, the core, which can be an aluminum or steel cylinder, is degreased with a solvent and cleaned with an abrasive cleaner prior to being primed with a primer, such as DOW CORNING 1200, which can be sprayed, brushed, or dipped, followed by air drying under ambient conditions for thirty minutes and then baked at about 150° C. for about 30 minutes.

Also suitable are quartz and glass substrates. The use of quartz or glass cores in fuser members allows for a lightweight, low cost fuser system member to be produced. Moreover, the glass and quartz help allow for quick warm-up, and are therefore energy efficient. In addition, because the core of the fuser member comprises glass or quartz, there is a real possibility that such fuser members can be recycled. Moreover, these cores allow for high thermal efficiency by providing superior insulation.

If the fuser member is a belt, the substrate can be of any desired or suitable material, including plastics, such as ULTEM, available from General Electric, ULTRAPEK, available from BASF, PPS (polyphenylene sulfide) sold under the tradenames FORTRON, available from Hoechst Celanese, RYTON R-4, available from Phillips Petroleum, and SUPEC, available from General Electric; PAI(polyamide imide), sold under the tradename TORLON 7130, available from Amoco; polyketone (PK), sold under the tradename KADEL E1230, available from Amoco; PT (polyimide); polyaramide; PEEK (polyether ether ketone), sold under the tradename PEEK 450GL30, available from Victrex; polyphthalamide sold under the tradename AMODEL, available from Amoco; PES (polyethersulfone); PEI (polyetherimide); PAEK (polyaryletherketone); PBA (polyparabanic acid); silicone resin; and fluorinated resin, such as PTFE (polytetrafluoroethylene); PFA (perfluoroalkoxy); FEP (fluorinated ethylene propylene); liquid crystalline resin (XYDAR), available from Amoco; and the like, as well as mixtures thereof. These plastics can be filled with glass or other minerals to enhance their mechanical strength without changing their thermal properties. In embodiments, the plastic comprises a high temperature plastic with superior mechanical strength, such as polyphenylene sulfide, polyamide imide, polyimide, polyketone, polyphthalamide, polyether ether ketone, polyethersulfone, and polyetherimide. Suitable materials also include silicone rubbers. Examples of belt-configuration fuser members are disclosed in, for example, U.S. Pat. Nos. 5,487,707 and 5,514,436, the disclosures of each of which are totally incorporated herein by reference. A method for manufacturing reinforced seamless belts is disclosed in, for example, U.S. Pat. No. 5,409,557, the disclosure of which is totally incorporated herein by reference.

The fuser member may include an intermediate layer, which can be of any suitable or desired material. For example, the intermediate layer can comprise a silicone rubber of a thickness sufficient to form a conformable layer, Suitable silicone rubbers include room temperature vulcanization (RTV) silicone rubbers, high temperature vulcanization (HTV) silicone rubbers, and low temperature vulcanization (LTV) silicone rubbers. These rubbers are known and are readily available commercially such as SILASTIC 735 black RTV and SILASTIC 732 RTV, both available from Dow Corning, and 106 RTV Silicone Rubber and 90 RTV Silicone Rubber, both available from General Electric. Other suitable silicone materials include the silanes, siloxanes (preferably polydimethylsiloxanes), such as fluorosilicones, dimethylsilicones, liquid silicone rubbers, such as vinyl crosslinked heat curable rubbers or silanol room temperature crosslinked materials, and the like. Other materials suitable for the intermediate layer include polyimides and fluoroelastomers. The intermediate layer may have a thickness of from about 0.05 to about 10 millimeters, such from about 0.1 to about 5 millimeters or from about 1 to about 3 millimeters.

The layers of the fuser member can be coated on the fuser member substrate by any desired or suitable means, including normal spraying, dipping, and tumble spraying techniques. A flow coating apparatus as described in U.S. Pat. No. 6,408,753, the disclosure of which is totally incorporated herein by reference, can also be used to flow coat a series of fuser members. In embodiments, the polymers may be diluted with a solvent, such as an environmentally friendly solvent, prior to application to the fuser substrate. Alternative methods, however, can be used for coating layers, including methods described in U.S. Pat. No. 6,099,673, the disclosure of which is totally incorporated herein by reference.

The outer layer of the fuser member may comprise a fluoropolymer such as polytetrafluoroethylene (PTFE), fluorinated ethylenepropylene copolymer (FEP), polyfluoroalkoxy (PFA), perfluoroalkoxy polytetrafluoroethylene (PFA TEFLON), ethylene chlorotrifluoro ethylene (ECTFE), ethylene tetrafluoroethylene (ETFE), polytetrafluoroethylene perfluoromethylvinylether copolymer (MFA), combinations thereof and the like.

In embodiments, the outer layer may further comprise at least one filler. Examples of fillers suitable for use herein include a metal filler, a metal oxide filler, a doped metal oxide filler, a carbon filler, a polymer filler, a ceramic filler, and mixtures thereof.

In embodiments, an optional adhesive layer may be located between the substrate and the intermediate layer. In further embodiments, the optional adhesive layer may be provided between the intermediate layer and the outer layer. The optional adhesive intermediate layer may be selected from, for example, epoxy resins and polysiloxanes.

As used herein, the following characteristics are defined as follows:

A. Minimum Fixing Temperature

The Minimum Fixing Temperature (MFT) is the minimum temperature (also called toner crease) at which acceptable adhesion of the toner to the image receiving substrate occurs, as determined by, for example, a creasing test, For example, the creasing test used to obtain the MFT measurement involves folding an image fused at a specific temperature, and rolling a standard weight across the fold. The folded image is then unfolded and analyzed under the microscope and assessed a numerical grade based on the amount of crease showing in the fold. This procedure is repeated at various temperatures until the minimum fusing temperature (showing very little crease) is obtained.

In embodiments, the MFT of the toner particles in the toner composition may be from about 100° C. to about 125° C., from about 110° C. to about 125° C., 115° C. to about 125° C. and from about 120° C. to about 125° C.

B. Stripping Force

Stripping Force was evaluated as follows. A number of unfused toner images, each consisting of two five centimeter (cm) by four cm solid area rectangles separated by a distance of one cm, were developed onto paper sheets with a paper weight of between 50 and 55 grams/square meter. Unfused images can be produced, for example, by copying or printing the image described above using a desktop xerographic copier or printer from which the fuser has been removed. Moreover, the xerographic developer for the desktop copier or printer has been replaced with a developer comprised of the toner particles to be evaluated for stripping force, and a suitable xerographic carrier. The toner images are produced with a toner mass per unit area of 1.25 milligrams/square centimeter. The paper sheets with unfused toner images are then passed, one at a time, through a two roll fuser system which has been equipped with a stripper finger in close proximity to the surface of the heat roll which contacts the unfused image, such that the stripper finger contacts the paper sheet as it exits the fuser nip, and passes along the one cm gap between the two rectangular toner images. The stripper finger is equipped with a strain gauge which measures the force exerted on the stripper finger by the paper sheet as it exits the fuser nip, which is a measure of the adhesive force between the fused toner image and the heat roll as it is stripped from the roll. The maximum force exerted on the stripper finger during the passage of the toner image through the fuser is recorded as the Stripping Force. The Stripping Force is measured for fusing temperatures between about 140° C. and 180° C. A maximum Stripping Force of less than 25 grams force is considered acceptable.

C. Gloss

Print gloss (Gardner gloss units or "ggu") was measured using a 75° C. BYK Gardner gloss meter for toner images that had been fused at a fuser roll temperature range of about 120° C. to about 210° C. (sample gloss is dependent on the toner, the toner mass per unit area, the paper substrate, the fuser roll, and fuser roll temperature).

In embodiments, the toner of the present disclosure may produce a fused image that has a gloss generally at least about 8 gloss units higher, typically at least about 12 gloss units higher, and more typically at least about 15 gloss units higher, than prior art EA toners prepared from a formulation comprising a latex having a weight average molecular weight higher than about $25\times10^3$, for example, mainline EA latex with a weight average molecular weight of $33\times10^3$ to $35\times10^3$.

Gloss is a subjective term used to describe the relative amount and nature of mirror like (specular) reflection. Different types of gloss are frequently arbitrarily differentiated, such as sheen, distinctness-of-image gloss, etc. Gloss value may be the numerical value for the amount of specular reflection relative to that of a standard surface under the same geometric conditions. Because the gloss of a specimen can vary greatly with the angle of observation, it has been standardized on angles of 20° C., 60° C., 75° C., and 85° C. degrees to the normal for its measurement. Gloss measured at an angle of 85° C. is commonly referred to as sheen.

In embodiments, gloss units refer to the number obtained by measuring the fused image using a Gardner Gloss metering unit set to a measurement angle of 75° C.

In a specific embodiment, the toner can produce high gloss images that were obtained on two different belt fuser designs, either a low oil belt fuser subsystem, or an oil-less fuser design such as the free belt nip fuser (FBNF) currently used in xerographic devices.

D. Hot And Cold Offset

Another important property for xerographic toner compositions is fusing property on paper. Due to energy conservation measures, and more stringent energy characteristics placed on xerographic engines, such as on xerographic fusers, there is pressure to reduce the fixing temperatures of toners onto paper to permit less power consumption and allowing the fuser system to possess extended lifetimes.

For a contact fuser, that is, a fuser which is in contact with the paper and the image, the toner should not substantially transfer or offset onto the fuser roller, referred to as hot or cold offset temperature. The lowest temperature at which the toner adheres to the support medium is referred to as the cold offset temperature (COT), and the maximum temperature at which the toner does not adhere to the fuser member is referred to as the hot offset temperature (HOT). When the fuser temperature exceeds HOT, some of the molten toner adheres to the fuser member during fixing and is transferred to subsequent substrates containing developed images resulting, for example, in blurred images. This undesirable phenomenon is known as offsetting.

In embodiments, the hot offset temperature of the toner composition is greater than about 215° C., such as, for example, from about 215° C. to about 250° C., from about 215° C. to about 240° C., from about 220° C. to about 240° C. and from about 220° C. to about 225° C. Furthermore, the cold offset temperature of the toner composition is less than about 130° C., such as, for example, from about 100° C. to about 130° C., from about 110° C. to about 130° C., from about 120° C. to about 130° C. and from about 125° C. to about 130° C.

E. Fusing Latitude

Another desirable characteristic of a toner is sufficient release of the paper image from the fuser roll. For oil containing fuser rolls, the toner may not contain a wax. However, for fusers without oil on the fuser (usually hard rolls), the toner will usually contain a lubricant like a wax to provide release and stripping properties. Thus, a toner characteristic for contact fusing applications is that the fusing latitude, that is, the temperature difference between the minimum fixing temperature (MFT) and the hot offset temperature, should be from about 50° C. to about 100° C., from about 75° C. to about 100° C., from about 80° C. to about 100° C. and from about 90° C. to about 95° C.

F. Charging

For the evaluation of toner particles in Toner Examples A-B and Comparative Examples A-B, the parent charge was measured by conditioning the toner at 5% TC (Toner Concentration) with standard 35 micron Xerox DocuColor 2240 carrier, in both A-zone and C-zone overnight, followed by charge evaluation after either 2 minutes or 60 minutes of mixing on a Turbula mixer. Humidity sensitivity is an important charging property for EA toners. The charging performance was tested in two environmental chambers, one is a low-humidity zone (also known as the C-zone), while another one is a high humidity zone (also known as the A-zone). The C-zone had a 15% relative humidity (RH) at an operating temperature of 10° C., and the A-zone had a 85% relative humidity at an operating temperature of 28° C. The quantity of charge is a value measured through image analysis of the charge-spectrograph process (CSG). Toner charge-to-diameter ratios (q/d) in C-and A-zones, typically with a unit of femtocoulombs/micron(mm), were measured on a known standard charge spectrograph. Furthermore, the tribo blow-off Q/m values in μC/g were also measured using a blow-off method with a Barbetta Box. A prescribed amount of toner is blended with the carrier. The blending is performed by the paint shaker in four (4) ounce glass jars. The blending of the toner and carrier components results in an interaction, where toner particles become negatively charged and carrier particles become positively charged. Samples of the resulting mixture are loaded into a Robot Cage and weighed. Via instrument air and a vacuum source, the toner is removed from the carrier, while the carrier is retained by the screened Robot Cage. The residual charge on the carrier is detected by an electrometer in Coulombs (relating to Tribo). The residual charge and the weight of toner blown off can be used to calculate the Tribo. Using the weights of toner blown off and retained carrier, the toner concentration can be calculated.

EXAMPLES

A. Resin Preparation

Preparation of Low Molecular Weight Amorphous Polyester Resin (Latex A)

A resin dispersion of Latex A, an amorphous poly(propoxylated bisphenol A-co-fumaric acid) resin latex, was prepared via a phase immersion emulsification (PIE) process using the following formulation: 10/5.0/1.25/84%/30 (Resin/methyl ethyl ketone (MEK)/isopropyl alcohol (IPA), ammonia/deionized water. The reactor was heated with a jacket set point of 60° C. A defoamer, TEGO FOAMEX 830 (approximately 700 ppm) was added incrementally to the reactor through a charging port. Once the reactor reached a temperature of 58° C., vacuum distillation began. After 36 minutes, the reactor reached a pressure of 74 mm of Hg. The resin dispersion of Latex A was then quickly distilled, which reduced the temperature of the reactor from about 45° C. The total amount of time to reach the desired amount of residual solvents (<100 ppm) was about 14-16 hours. 1000 ppm of PROXEL GXL biocide was then added to the resin dispersion. After drying, Latex A possessed a Mw of 19.8 Kpse, Mn of 4.9 Kpse, ™ 115.7° C. and Tg of 59.2° C. with an average particle size D50 of 170 nm and width of 0.1.

Preparation of High Molecular Weight Amorphous Polyester Resin (Latex B)

A resin dispersion of Latex B, an amorphous poly(propoxylated bisphenol A-co-fumaric acid) resin latex, was prepared via a phase immersion emulsification (PIE) process using the following formulation: 10/6.0/1.35/75%/30 (Resin/methyl ethyl ketone (MEK)/isopropyl alcohol (IPA), ammonia/deionized water. The reactor was heated with a jacket set point of 60° C. A defoamer, Tego Foamex 830 (approximately 700 ppm) was added incrementally to the reactor through a charging port. Once the reactor reached a temperature of 56.4° C., vacuum distillation began. After 45 minutes, the reactor reached a pressure of 116 mm of Hg. The resin dispersion of Latex B was then quickly distilled, which reduced the temperature of the reactor from about 44.5° C. The total amount of time to reach the desired amount of residual solvents (<100 ppm) was about 14-16 hours. 1000 parts per million (ppm) of PROXEL GXL biocide was then added to the resin dispersion. After drying, Latex B possessed a Mw of 93.9 Kpse, Mn of 6.3 Kpse, Tm 128.6° C. and ™ of 56.1° C. with an average particle size D50 of 170 nm and width of 0.1.

Preparation of Crystalline Polyester Resin (Latex C)

A ZSK-53 extruder, equipped with a feed hopper and liquid injection ports was headed to approximately 95° C. and fed a mixture of sodium hydroxide, DOWFAX 2A1 and a crystalline polyester resin (poly(dodecandioicacid-co-nonanediol). Water heated to 80° C. was feed into the extruder's first injection port at a feed rate of 1.0 kg/min using a diaphragm pump, wherein the mixture began to emulsify. The polyester resin emulsion had a number and volume average particle size of 58 nm and 67 nm, respectively. 1000 ppm of PROXEL GXL biocide was then added to the resin dispersion. After drying, the molecular properties of the latex were a Mw of 23.9 Kpse and a Mn of 11.1 Kpse, wherein the polyester latex possesses an average particle size D50 of 160 nm.

B. Toner Preparation

Preparation of Toner Example A

In a 6000 gallon reactor, 14 parts of Latex A (solids content 35 weight percent and 1000 ppm of PROXEL GXL) 14 parts Latex B (solids content 35 weight percent and 1000 ppm of PROXEL GXL) 4.7 parts Latex C (solids content 30 weight percent and 1000 ppm of PROXEL GXL) 5.8 parts IGI wax, (solids content 30 weight percent), 6.7 parts Cyan 15:3 pigment (solids content 17 weight percent), 0.3 parts DOWFAX surfactant and 47 parts of deionized water were combined. The pH of the mixture was adjusted to about 3.2 using a 0.3 M solution of nitric acid ($HNO_3$). Next, 1.0 parts of a 10 weight percent aluminum sulfate ($Al_2(SO_4)_3$) solution homogenized using a Cavitron rotor/stator homogenizer at 2000 RPM was added over a period of 5 minutes. The reactor was then stirred to about 50 RPM and heated to about 48° C. to aggregate the toner particles.

When the size of the toner particles was determined to be about 5.0 μm, a shell was coated on the toner particles. The shell mixture comprised of 7.6 parts of Latex A, 7.6 parts of Latex B, 0.1 parts of DOWFAX surfactant and 100 parts of deionized water. After heating the reactor to 50° C., the size of the toner particles reduced to 5.8 μm and the pH of the solution was adjusted to 5.0 using a 4% sodium hydroxide solution. The reactor RPM was then decreased to about 45 RPM, followed by the addition of 0.7 parts of ethylenediaminetetraacetic acid (g) VERSENE 100. After adjusting and holding constant the pH of the toner particle solution to 7.5, the toner particle solution was heated to a coalescence temperature of 85° C. Once the toner particle solution reached the coalescence temperature, the pH was lowered to a value of 7.3 to allow spherodization (coalescence) of the toner. After about 1.5 to 3.0 hours, the toner particles possessed the desired circularity of about 0.964 and were quenched to a temperature less than 45° C. using a heat exchanger. Upon cooling, the toners were washed to a temperature remove any residual surfactants and/or any residual ions, and dried to a moisture content below 1.2 weight percent.

Preparation of Toner Example B

In a 6000 gallon reactor, 13.5 parts of Latex A (solids content 35 weight percent and 1000 ppm of PROXEL GXL) 13.5 parts Latex B (solids content 35 weight percent and 1000 ppm of PROXEL GXL) 4.7 parts Latex C (solids content 30 weight percent and 1000 ppm of PROXEL GXL) 5.7 parts IGI wax, (solids content 30 weight percent), 6.7 parts PY74 yellow pigment (solids content 19 weight percent), 0.3 parts DOWFAX surfactant and 47 parts of deionized water were combined. The pH of the mixture was adjusted to about 3.2 using a 0.3 M solution of nitric acid ($HNO_3$). Next, 1.0 parts of a 10 weight percent aluminum sulfate ($Al_2(SO_4)_3$) solution homogenized using a Cavitron rotor/stator homogenizer at 2000 RPM was added over a period of 5 minutes. The reactor was then stirred to about 50 RPM and heated to about 48° C. to aggregate the toner particles.

When the size of the toner particles was determined to be about 5.0 μm, a shell was coated on the toner particles. The shell mixture comprised of 7.6 parts of Latex A, 7.6 parts of Latex B, 0.1 parts of DOWFAX surfactant and 100 parts of deionized water. After heating the reactor to 50° C., the size of the toner particles reduced to 5.8 μm and the pH of the solution was adjusted to 5,0 using a 4% sodium hydroxide solution. The reactor RPM was then decreased to about 45 RPM, followed by the addition of 0.7 parts of ethylenediaminetetraacetic acid (EDTA) VERSENE 100. After adjusting and holding constant the pH of the toner particle solution to 7.5, the toner particle solution was heated to a coalescence temperature of 85° C. Once the toner particle solution reached the coalescence temperature, the pH was lowered to a value of 7.3 to allow spherodization (coalescence) of the toner. After about 1.5 to 3.0 hours, the toner particles possessed the desired circularity of about 0.964 and were quenched to a temperature less than 45° C. using a heat exchanger. Upon cooling, the toners were washed to a temperature remove any residual surfactants and/or any residual ions, and dried to a moisture content below 1.2 weight percent.

Comparative Toner Example A

Comparative Toner Example A was prepared using the exact same components and in the exact same manner as Toner Example A, except that Comparative Toner Example A did not contain any biocide.

Comparative Toner Example B

Comparative Toner Example B was prepared using the exact same components and in the exact same manner as Toner Example B, except that Comparative Toner Example B did not contain any biocide.

C. Toner Evaluation

The toners of Toner Examples A-B and Comparative Toner Examples A-B, were evaluated using the XEROX Pinot 700 Digital Color Press. The toners were fused at 220 mm/s (34 ms nip dwell, oil-less) onto Color Xpressions (90 gsm) paper for gloss, minimum fixing temperature (or crease), cold offset performance, and hot offset performance. The temperature of the fuser roll was varied from cold offset to hot offset (up to 210° C.) for gloss and crease measurements. The fusing performance of the toners are listed in Table 1.

TABLE 1

| | Toner Example A | Toner Example B | Toner Comparative Example A | Toner Comparative Example B |
|---|---|---|---|---|
| Minimum Fixing Temperature (MFT) (° C.) | 123 | 121 | 133 | 132 |
| Gloss At MFT (GGU) | 25.4 | 27.1 | 28.4 | 28.4 |
| Hot Offset Temperature (° C.) | 220 | 220 | 210 | 210 |
| Fusing Latitude | 97 | 99 | 77 | 78 |
| Cold Offset Temperature (° C.) | 126 | 127 | 133 | 132 |

The charging performance for Toner Example A and Toner Example B was also evaluated. Both Toner Example A and Toner Example B exhibited satisfactory charging performance.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A toner composition comprising at least one low molecular weight amorphous polyester resin, at least one high molecular weight amorphous polyester resin, at least one crystalline polyester resin, at least one wax, at least one biocide, and at least one colorant, wherein the at least one low molecular weight amorphous polyester resin has a weight average molecular weight of from 2,000 to 50,000 and is present in the toner composition in an amount of about 25 to about 50 weight percent, the at least one high molecular weight amorphous polyester resin has a weight average molecular weight of from 55,000 to 150,000 and is present in the toner composition in an amount of about 25 to about 50 weight percent, the at least one crystalline polyester resin is present in the toner composition in an amount of 1 to about 15 weight percent, the at least one wax is present in the toner composition in an amount of 1 to about 15 weight percent, the at least one biocide is present in the toner composition in a concentration of 950 ppm to about 1000 ppm, and the at least one colorant is present in the toner composition in an amount of 1 to about 15 weight percent, wherein the crystalline polyester resin has an acid value (AV) of from about 8 to about 13 mg KOH/g, a $M_w$ of from about 21,000 to about 24,000, and a $M_n$ of from about 6,000 to about 12,000, and wherein the toner composition has a minimum fusing temperature of from about 100° C. to about 125° C.

2. The toner composition of claim 1, wherein the toner composition has a fusing latitude of from about 80° C. to about 100° C.

3. The toner composition of claim 1, wherein the toner composition further comprises a photoinitiator and a surfactant.

4. The toner composition of claim 1, wherein the at least one wax is a polyethylene wax or a paraffin wax.

5. The toner composition of claim 1, wherein the toner composition has a shape factor of about 120 to about 140 and circularity of about 0.950 to about 0.985.

6. The toner composition of claim 1, wherein the toner composition further includes an organic complexing agent selected from the group consisting of ethylenediaminetetraacetic acid, gluconal, sodium gluconate, potassium citrate, sodium citrate, nitrotriacetate salt, humic acid, fulvic acid and combinations thereof.

7. The toner composition of claim 1, wherein the toner composition further includes an inorganic complexing agent selected from the group consisting of sodium silicate, potassium silicate, magnesium sulfate silicate and combinations thereof.

8. The toner composition according to claim 1, wherein the toner composition has a hot offset temperature of from about 215° C. to about 250° C.

9. A toner composition comprising at least one low molecular weight amorphous polyester resin, at least one high molecular weight amorphous polyester resin, at least one crystalline polyester resin, at least one wax, at least one biocide, and at least one colorant, wherein the at least one low molecular weight amorphous polyester resin is present in the toner composition in an amount of about 25 to about 50 weight percent, the at least one high molecular weight amorphous polyester resin has a weight average molecular weight of from 55,000 to 150,000 and is present in the toner composition in an amount of about 25 to about 50 weight percent, the at least one crystalline polyester resin is present in the toner composition in an amount of 1 to about 15 weight percent, the at least one wax is present in the toner composition in an amount of 1 to about 15 weight percent, the at least one biocide is present in the toner composition in a concentration of 950 ppm to about 1000 ppm, and the at least one colorant is present in the toner composition in an amount of 1 to about 15 weight percent, wherein the toner composition has a minimum fusing temperature of from about 100° C. to about 125° C., and wherein the at least one low molecular weight amorphous polyester resin has a melting temperature ($T_m$) of from about 104° C. to about 110° C., a glass transition temperature ($T_g$) of from about 58° C. to about 62° C., an acid value (AV) of from about 9 to about 14 mg KOH/g, a $M_w$ of from about 18,000 to about 21,000, and a $M_n$ of from about 4,000 to about 6,000.

10. The toner composition of claim 9, wherein the crystalline polyester resin has an acid value (AV) of from about 8 to about 13 mg KOH/g, a $M_w$ of from about 21,000 to about 24,000, and a $M_n$ of from about 6,000 to about 12,000.

11. The toner composition of claim 9, wherein the toner composition has a fusing latitude of from about 80° C. to about 100° C.

12. The toner composition of claim 9, wherein the toner composition further comprises a photoinitiator and a surfactant.

13. The toner composition of claim 9, wherein the at least one wax is a polyethylene wax or a paraffin wax.

14. The toner composition of claim 9, wherein the toner composition has a shape factor of about 120 to about 140 and circularity of about 0.950 to about 0.985.

15. The toner composition of claim 9, wherein the toner composition further includes an organic complexing agent selected from the group consisting of ethylenediaminetetraacetic acid, gluconal, sodium gluconate, potassium citrate, sodium citrate, nitrotriacetate salt, humic acid, fulvic acid and combinations thereof.

16. The toner composition of claim 9, wherein the toner composition further includes an inorganic complexing agent selected from the group consisting of sodium silicate, potassium silicate, magnesium sulfate silicate and combinations thereof.

17. A toner composition comprising at least one low molecular weight amorphous polyester resin, at least one high molecular weight amorphous polyester resin, at least one crystalline polyester resin, at least one wax, at least one biocide, and at least one colorant, wherein the at least one low molecular weight amorphous polyester resin has a weight average molecular weight of from 2,000 to 50,000 and is present in the toner composition in an amount of about 25 to about 50 weight percent, the at least one high molecular weight amorphous polyester resin is present in the toner composition in an amount of about 25 to about 50 weight percent, the at least one crystalline polyester resin is present in the toner composition in an amount of 1 to about 15 weight percent, the at least one wax is present in the toner composition in an amount of 1 to about 15 weight percent, the at least one biocide is present in the toner composition in a concentration of 950 ppm to about 1000 ppm, and the at least one colorant is present in the toner composition in an amount of 1 to about 15 weight percent, wherein the toner composition has a minimum fusing temperature of from about 100° C. to about 125° C., and wherein the at least one high molecular weight amorphous polyester resin has a melting temperature ($T_m$) of from about 104° C. to about 110° C., a glass transition temperature ($T_g$) of from about 58° C. to about 62° C., an acid value (AV) of from about 9 to about 14 mg KOH/g, a $M_w$, of from about 68,000 to about 85,000, and a $M_n$ of from about 6,000 to about 8,000.

18. The toner composition of claim 17 wherein the crystalline polyester resin has an acid value (AV) of from about 8 to about 13 mg KOH/g, a $M_w$ of from about 21,000 to about 24,000, and a $M_n$ of from about 6,000 to about 12,000.

19. The toner composition of claim 17, wherein the toner composition has a fusing latitude of from about 80° C. to about 100° C.

20. The toner composition of claim 17, wherein the toner composition further comprises a photoinitiator and a surfactant.

21. The toner composition of claim 17, wherein the at least one wax is a polyethylene wax or a paraffin wax.

22. The toner composition of claim 17, wherein the toner composition has a shape factor of about 120 to about 140 and circularity of about 0.950 to about 0.985.

23. The toner composition of claim 17, wherein the toner composition further includes an organic complexing agent selected from the group consisting of ethylenediaminetetraacetic acid, gluconal, sodium gluconate, potassium citrate, sodium citrate, nitrotriacetate salt, humic acid, fulvic acid and combinations thereof.

24. The toner composition of claim 17, wherein the toner composition further includes an inorganic complexing agent selected from the group consisting of sodium silicate, potassium silicate, magnesium sulfate silicate and combinations thereof.

* * * * *